US010743690B2

(12) United States Patent
Beckman

(10) Patent No.: US 10,743,690 B2
(45) Date of Patent: Aug. 18, 2020

(54) DRINKING VESSEL AND ICE SUBMERSION TECHNIQUES

(71) Applicant: Christopher V. Beckman, Los Angeles, CA (US)

(72) Inventor: Christopher V. Beckman, Los Angeles, CA (US)

( * ) Notice: Subject to any disclaimer, the term of this patent is extended or adjusted under 35 U.S.C. 154(b) by 0 days.

(21) Appl. No.: 16/601,577

(22) Filed: Oct. 14, 2019

(65) Prior Publication Data

US 2020/0113362 A1 Apr. 16, 2020

Related U.S. Application Data

(63) Continuation of application No. 15/006,110, filed on Jan. 25, 2016, now abandoned.

(60) Provisional application No. 62/106,753, filed on Jan. 23, 2015.

(51) Int. Cl.

| | |
|---|---|
| ***A47G 19/22*** | (2006.01) |
| ***A47G 19/16*** | (2006.01) |
| ***A47G 9/10*** | (2006.01) |

(52) U.S. Cl.

CPC ..... *A47G 19/2288* (2013.01); *A47G 9/10* (2013.01); *A47G 19/16* (2013.01)

(58) Field of Classification Search

CPC .... A47G 19/2288; A47G 19/22; A47G 19/16; A47G 19/2211

USPC ..... 220/592.17, 719, 734

See application file for complete search history.

(56) References Cited

U.S. PATENT DOCUMENTS

| | | | | | |
|---|---|---|---|---|---|
| 1,847,879 | A * | 3/1932 | Knecht | A47G 19/2211 | 239/33 |
| 2,362,354 | A * | 11/1944 | Clovis | A47G 19/2211 | 220/719 |
| 2,690,064 | A * | 9/1954 | Rupe | A47G 19/2211 | 222/564 |
| 2,753,050 | A * | 7/1956 | Langston | A47G 19/2211 | 210/469 |
| 3,360,161 | A * | 12/1967 | Smith | A47G 19/2272 | 220/719 |
| 3,920,146 | A * | 11/1975 | Baller | A47G 19/2211 | 220/719 |
| 4,550,848 | A * | 11/1985 | Sucato | A45F 3/16 | 181/264 |
| 4,638,645 | A * | 1/1987 | Simila | F25D 3/08 | 62/371 |
| 4,768,674 | A * | 9/1988 | Prescott | A47G 19/2211 | 220/719 |
| 4,842,157 | A * | 6/1989 | Stone-Parker | A47G 19/2211 | 220/719 |

(Continued)

*Primary Examiner* — Steven A. Reynolds
*Assistant Examiner* — Javier A Pagan

(57) ABSTRACT

Methods and devices for enhancing drinking chilled drinking vessels are provided. In some aspects, a concentric set of arms or tabs in a pre-configured section of a drinking vessel applies holding pressure to expanded water poured within the section. A beverage is then poured over the frozen water, submerging it. In other aspects, holding pressure is maintained through flexible and/or adjustable arms, and lateral play eliminated, even if the frozen water melts. In other embodiments, a loop or set of loops extends from the center of the vessel above the section, and separate, flexible members (preferably cambered) are threaded through the loops after the water is frozen to apply greater holding pressure.

20 Claims, 20 Drawing Sheets

(56) References Cited

U.S. PATENT DOCUMENTS 4,938,375 A * 7/1990 Fantacone ..... A47G 19/2211 210/464
4,938,377 A * 7/1990 Jarvis ..... A47G 19/12 220/216
D353,298 S * 12/1994 Hartpence, Jr. ..... D7/396.2
5,370,258 A * 12/1994 Fair ..... A47G 19/2211 220/501
5,727,712 A * 3/1998 Costello ..... A47G 19/2211 220/703
5,857,584 A * 1/1999 Taggart ..... A47G 19/2211 220/23.9
5,971,202 A * 10/1999 Filbrun ..... A47G 19/2211 220/719
6,168,043 B1 * 1/2001 Yen ..... A47G 23/0241 220/501
6,588,622 B1 * 7/2003 Leishman ..... B65D 23/00 215/306
6,595,394 B1 * 7/2003 Savala ..... A47G 19/12 220/719
8,033,420 B2 * 10/2011 Roseblade ..... A47G 19/2211 220/369
D684,421 S * 6/2013 Flechel ..... D7/392.1
8,453,870 B2 * 6/2013 Berg ..... A47G 19/2272 220/703
8,459,492 B2 * 6/2013 Merino ..... A47G 19/2211 215/389
9,248,423 B2 * 2/2016 Cerasani ..... B65D 47/0885
9,352,901 B2 * 5/2016 Furrow ..... A47G 19/2222
9,730,539 B2 * 8/2017 Bolland ..... A47G 19/2205
9,823,007 B2 * 11/2017 Cheng ..... F25D 3/08
9,895,013 B2 * 2/2018 Walter ..... A47G 19/2211
2011/0240664 A1 * 10/2011 Liggens ..... A47G 19/2211 220/703
2013/0233866 A1 * 9/2013 Dooley ..... B65D 81/18 220/592.17
2016/0135628 A1 * 5/2016 Kim ..... A47G 19/2288 220/592.17

* cited by examiner

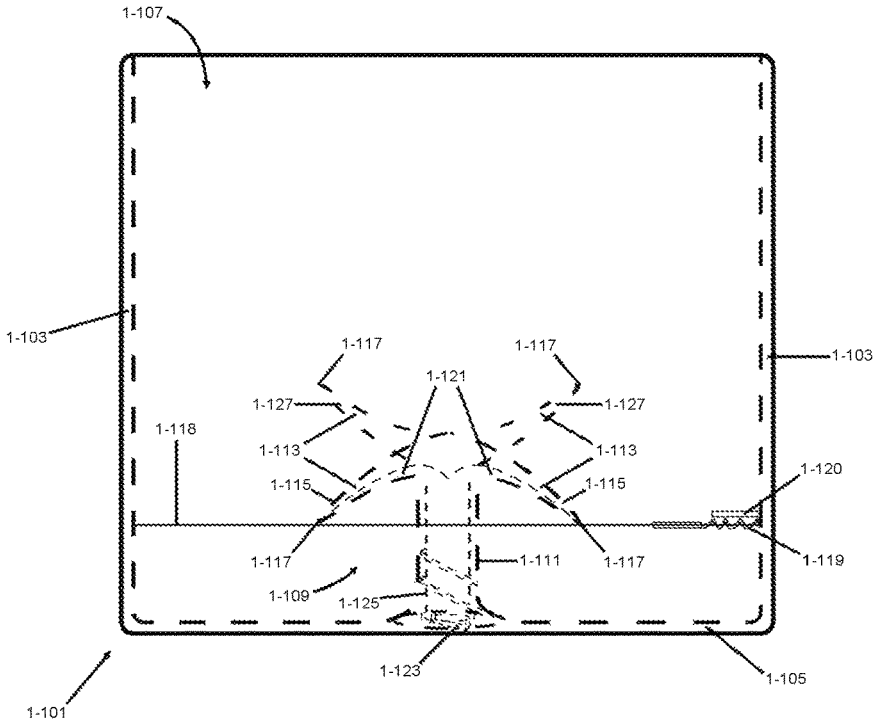
Fig. 1.1
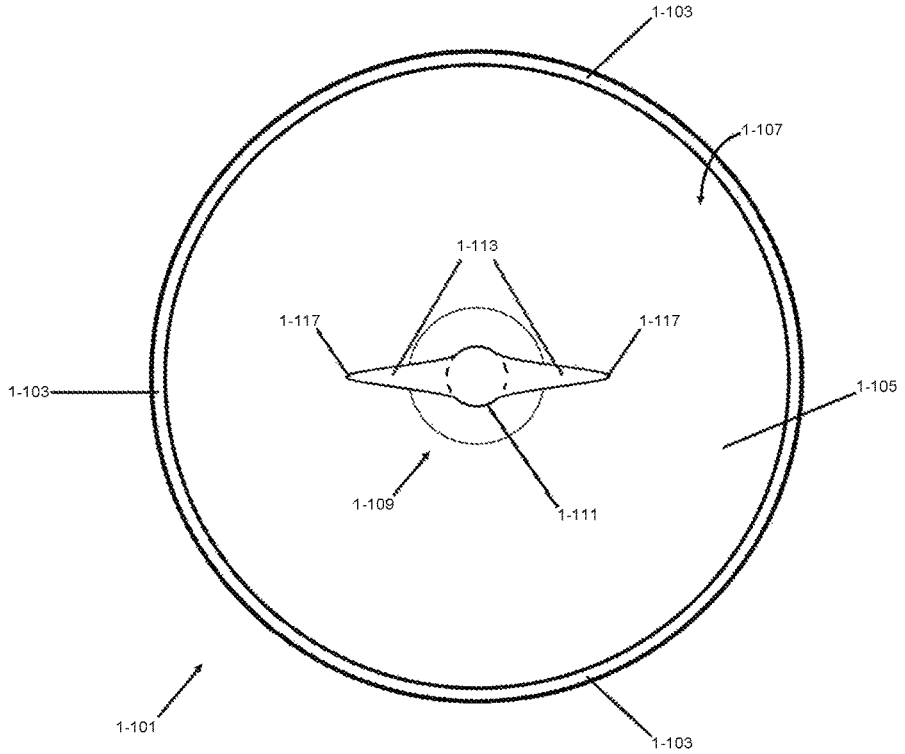
Fig. 1.2

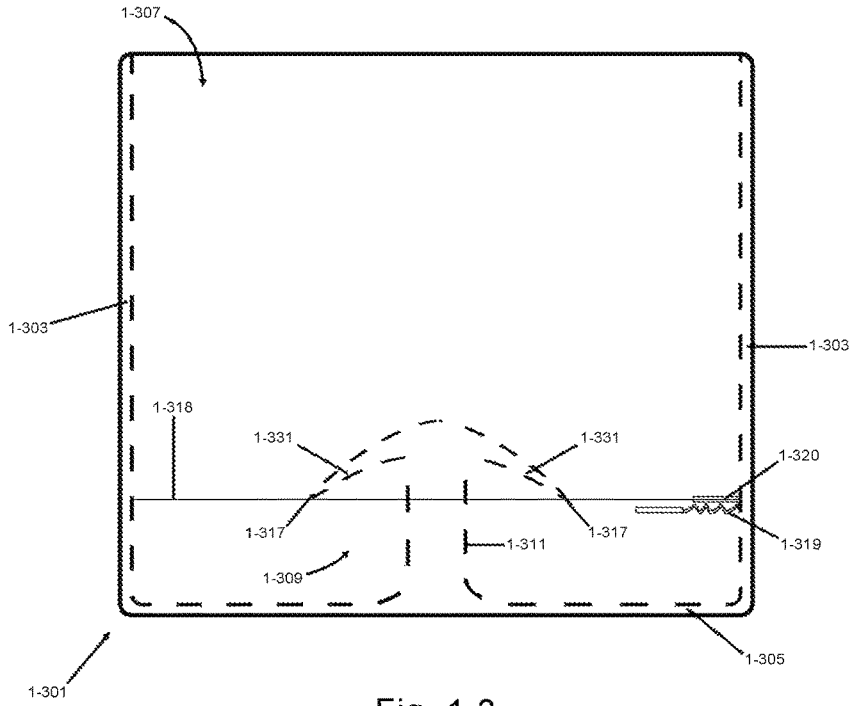
Fig. 1.3
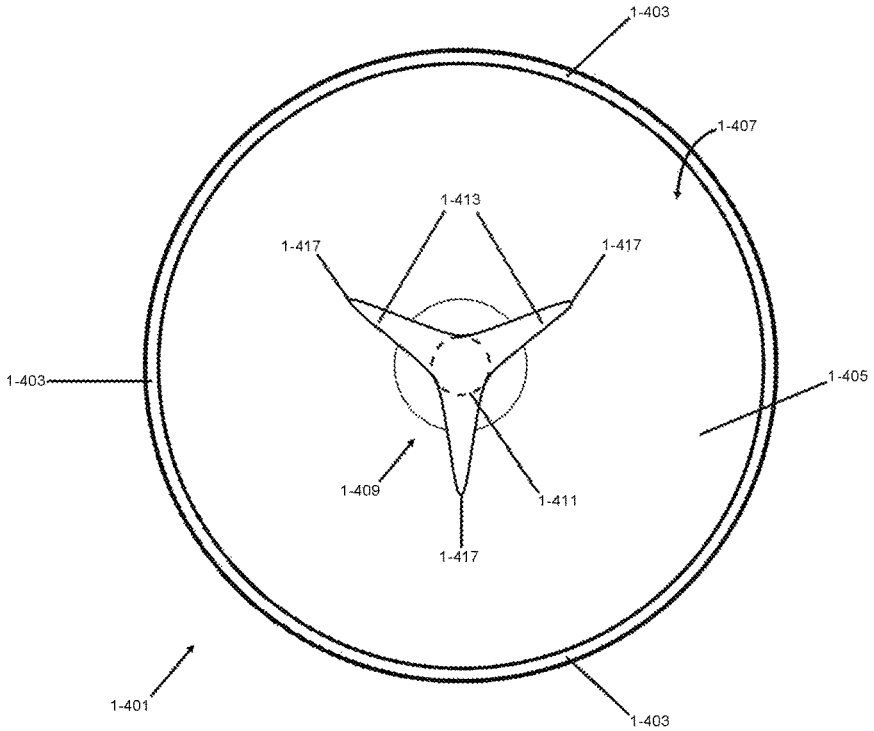
Fig. 1.4

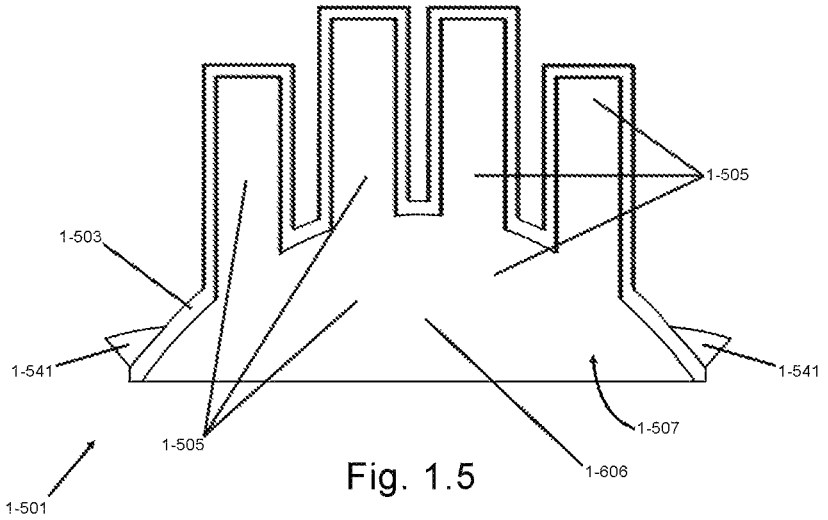
Fig. 1.5
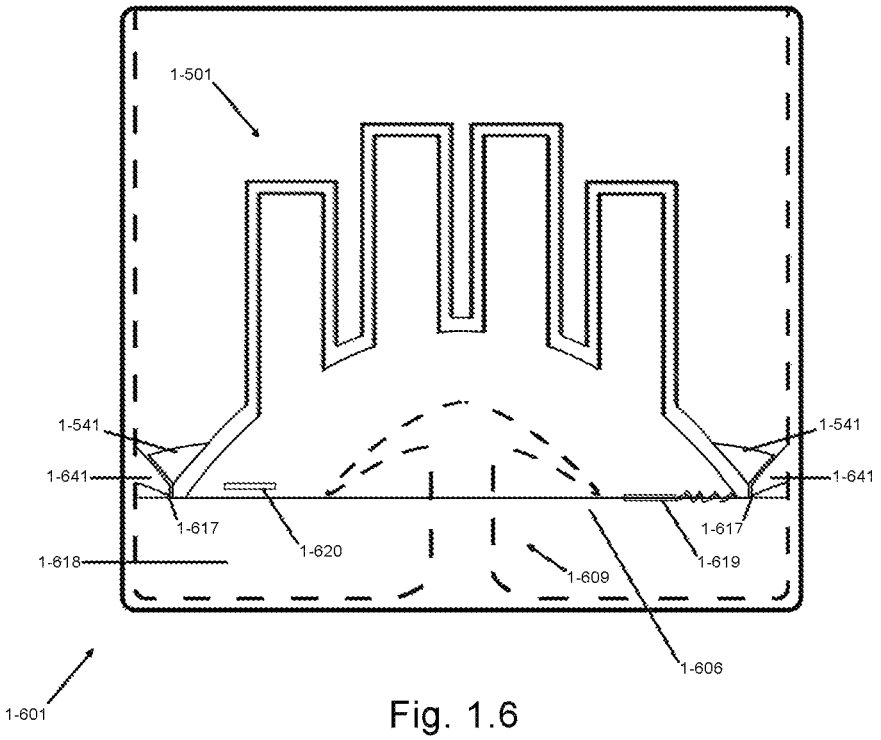
Fig. 1.6

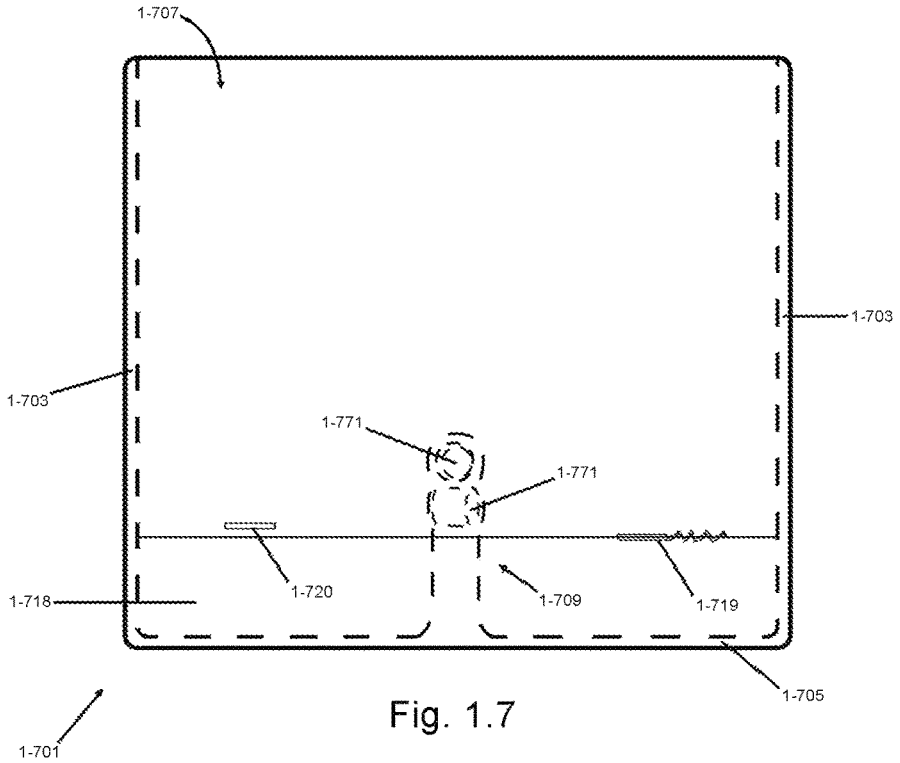
Fig. 1.7
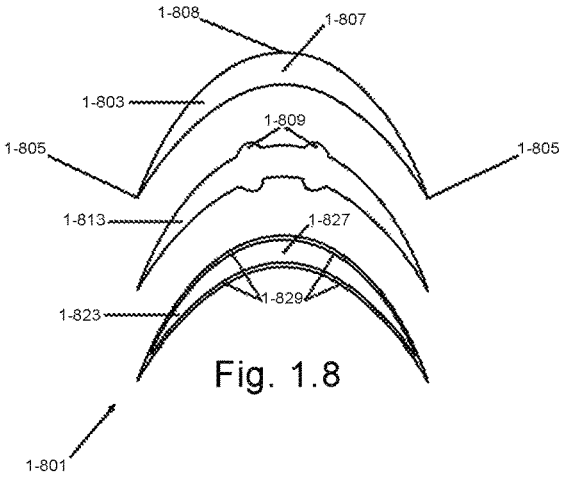
Fig. 1.8
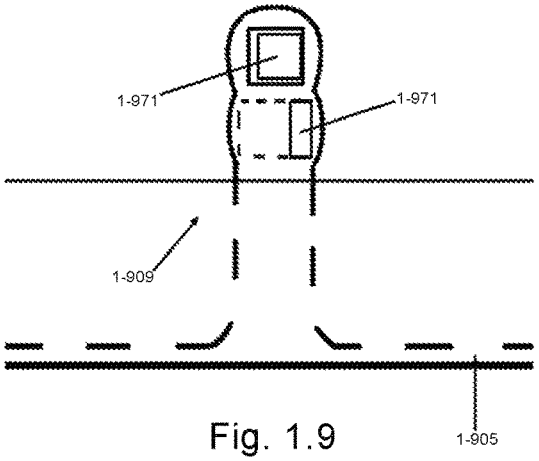
Fig. 1.9

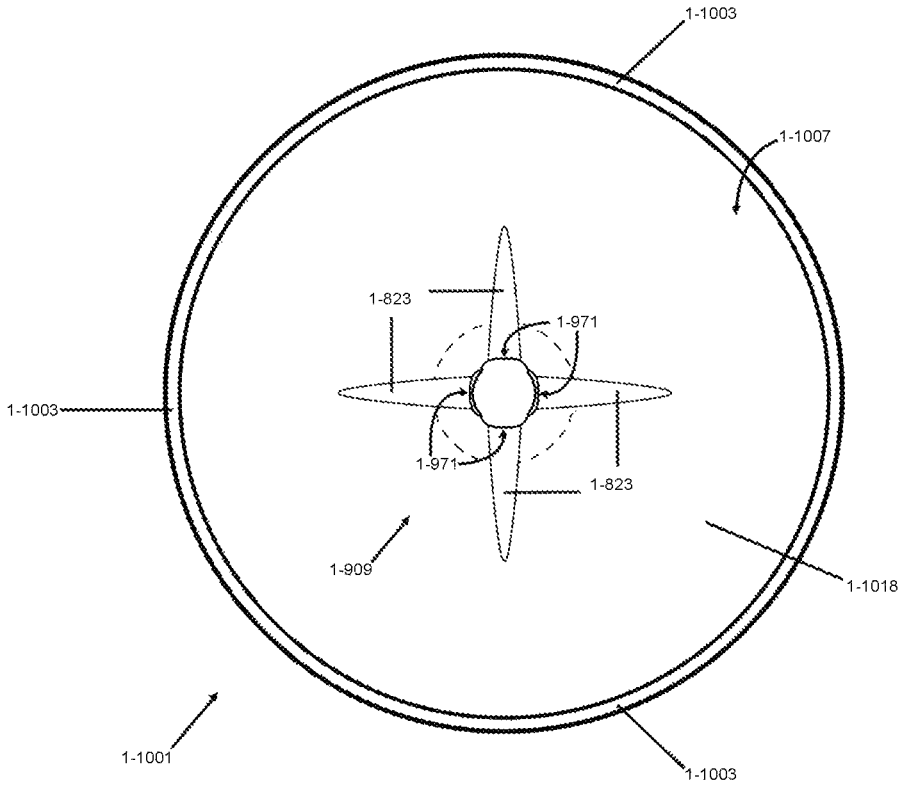
Fig. 1.10

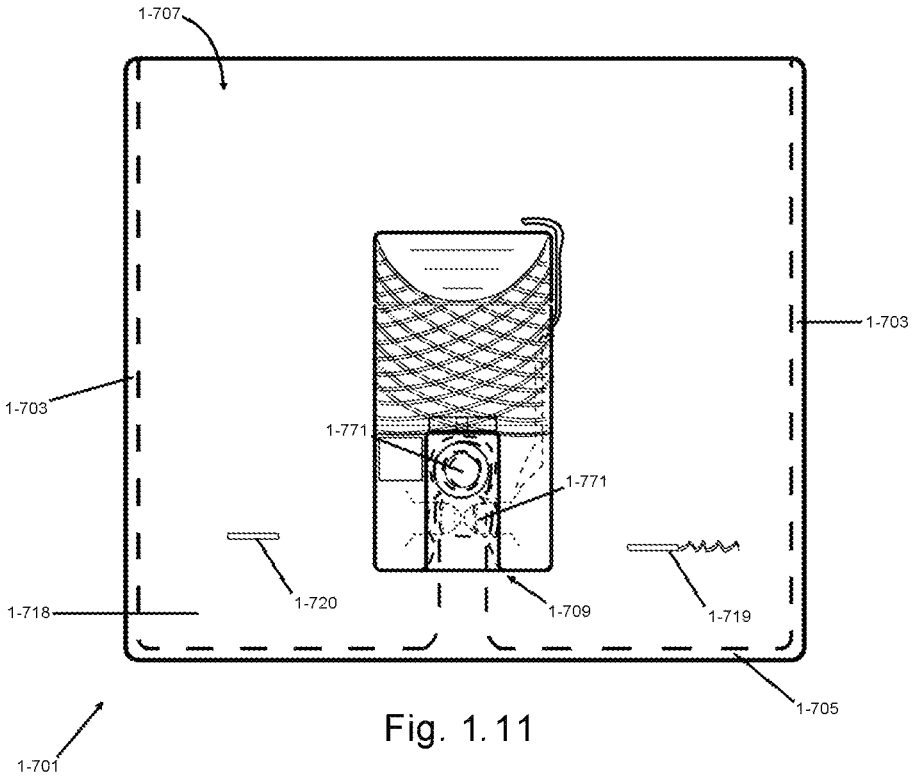
Fig. 1.11
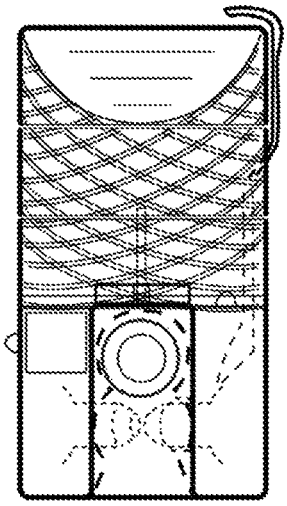
Fig. 1.12

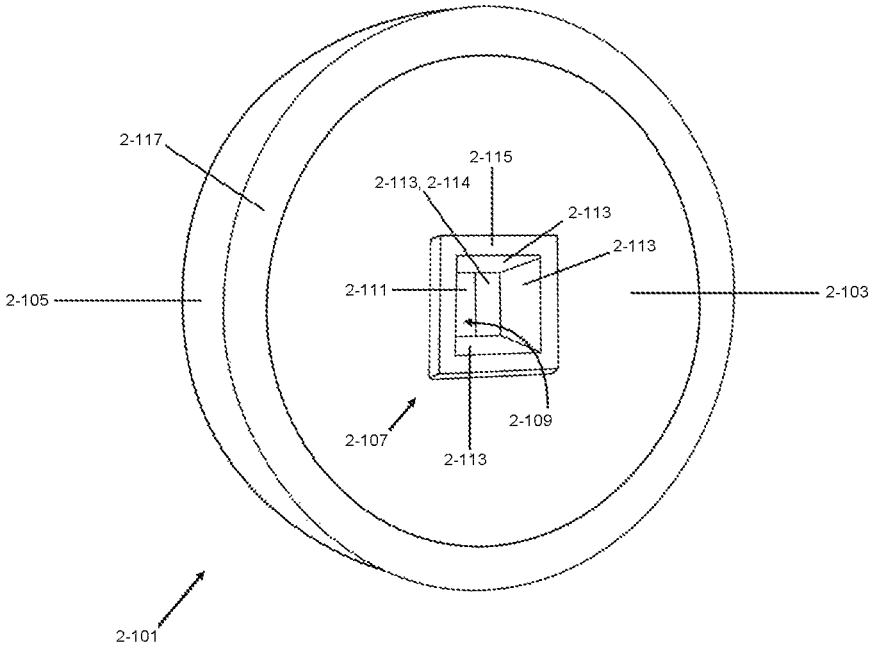
Fig. 2.1
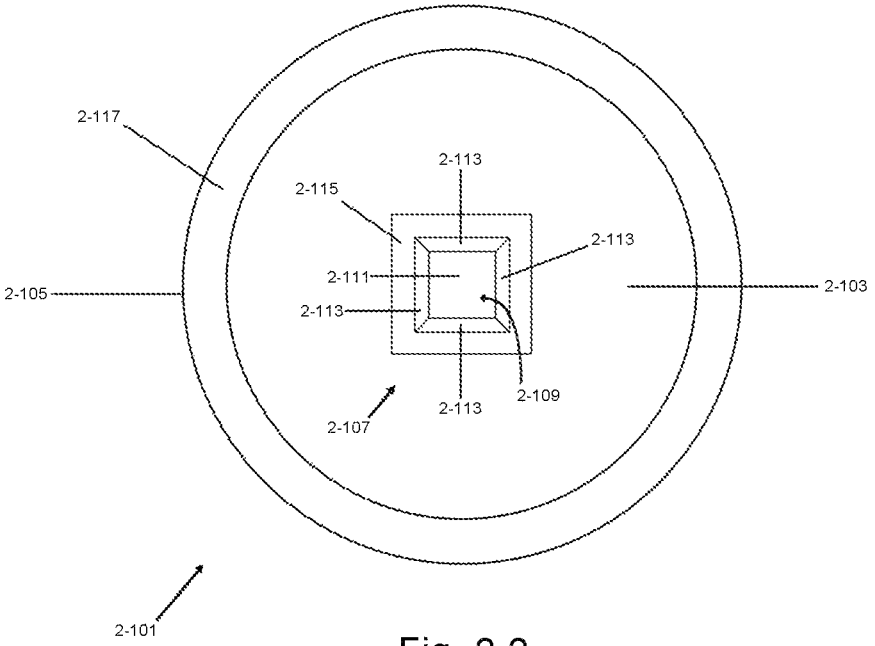
Fig. 2.2

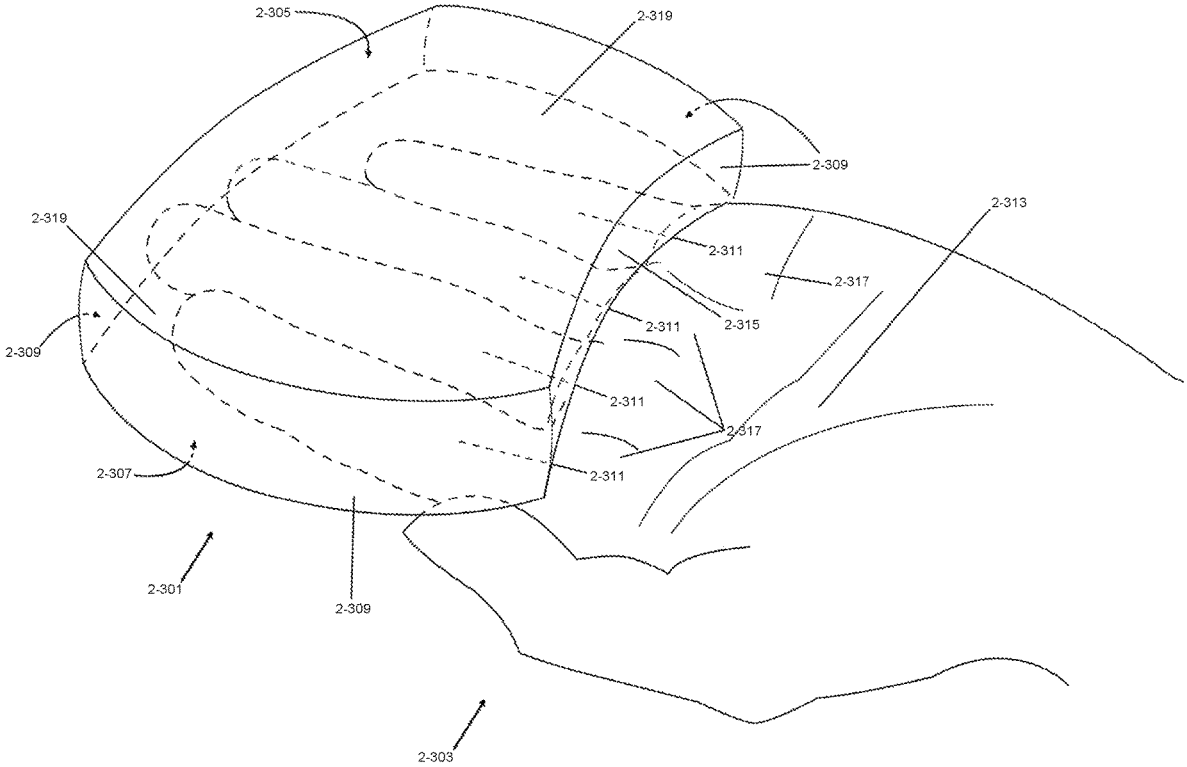
Fig. 2.3
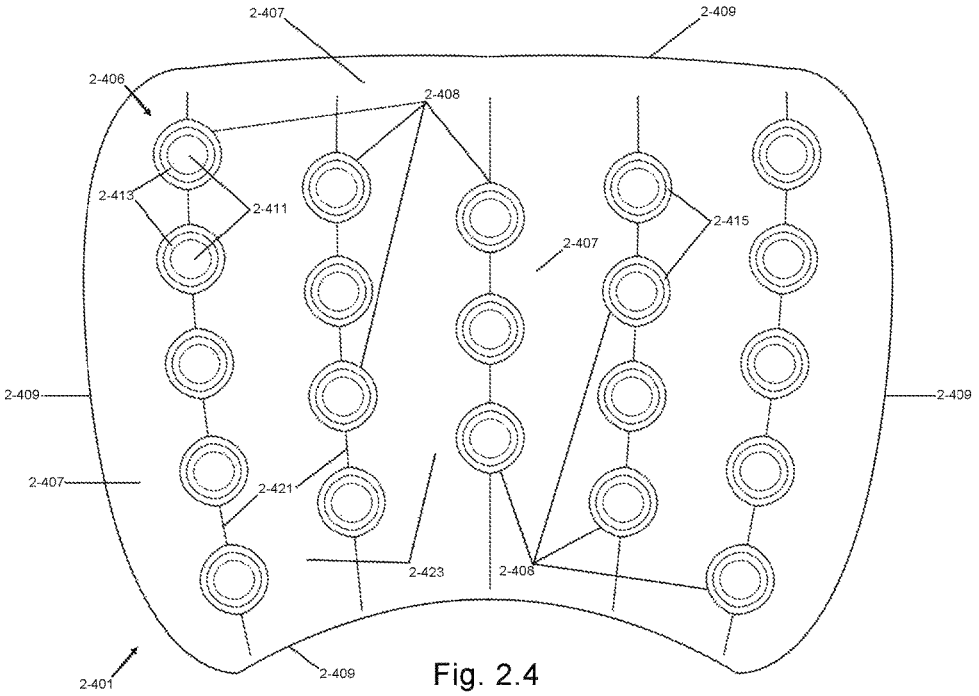
Fig. 2.4

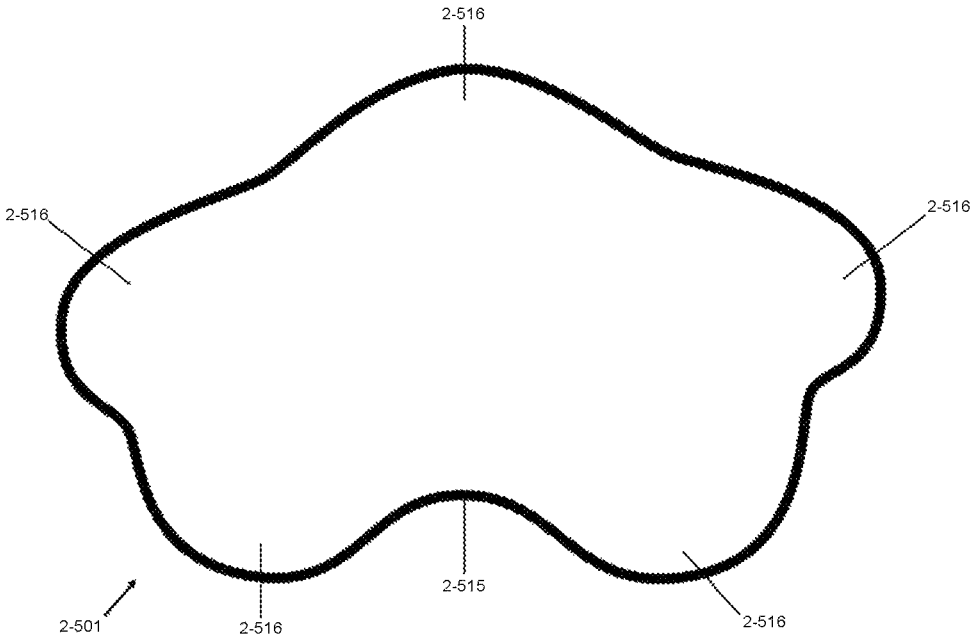
Fig. 2.5

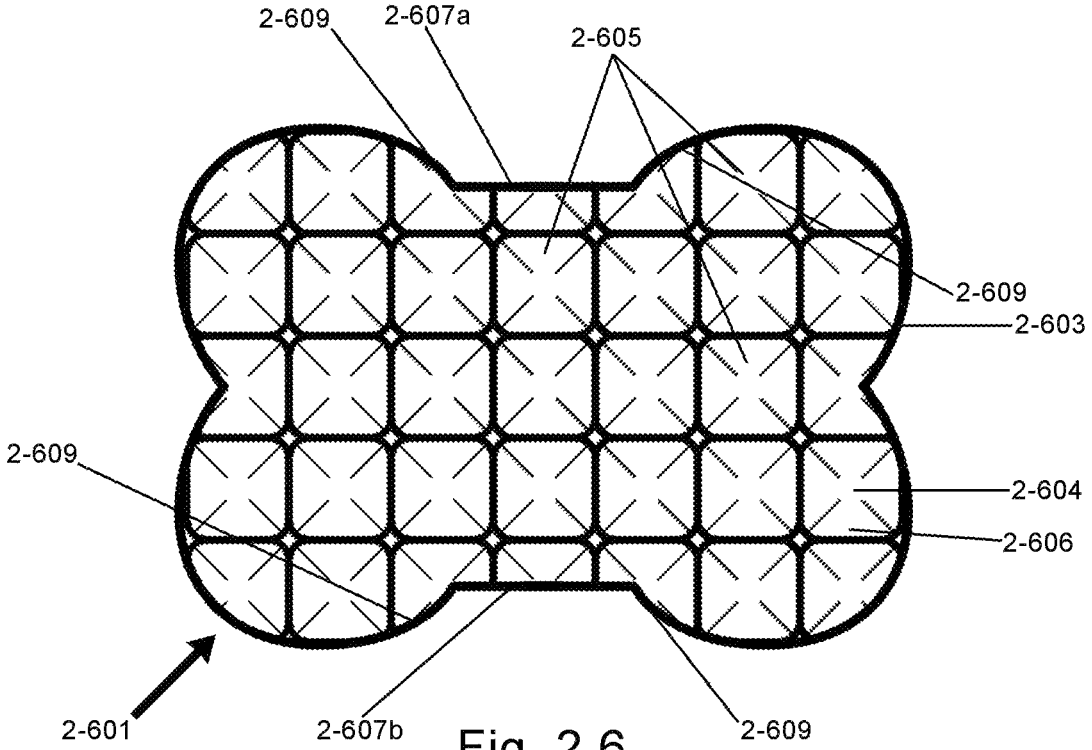
Fig. 2.6

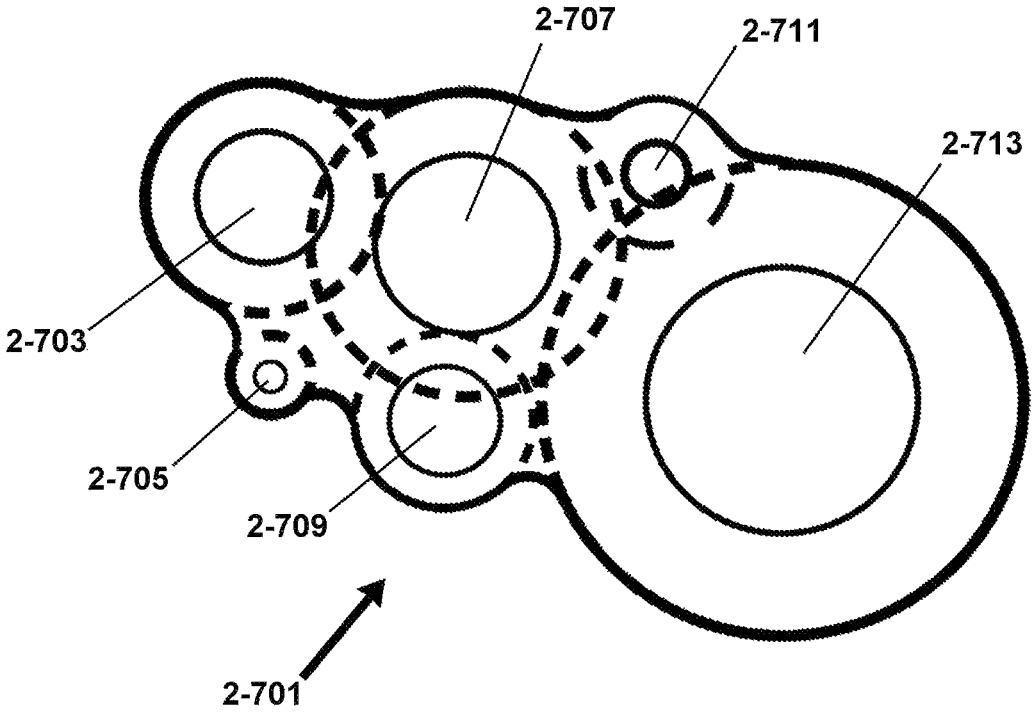
Fig. 2.7

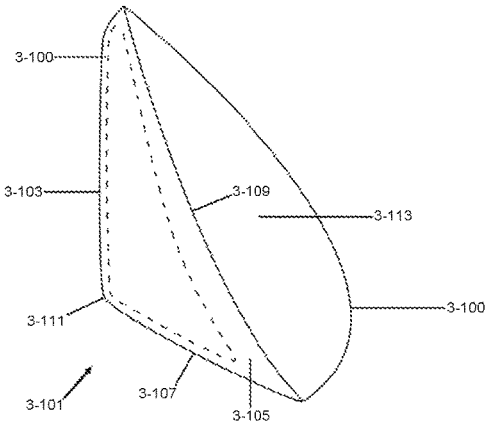
Fig. 3.1
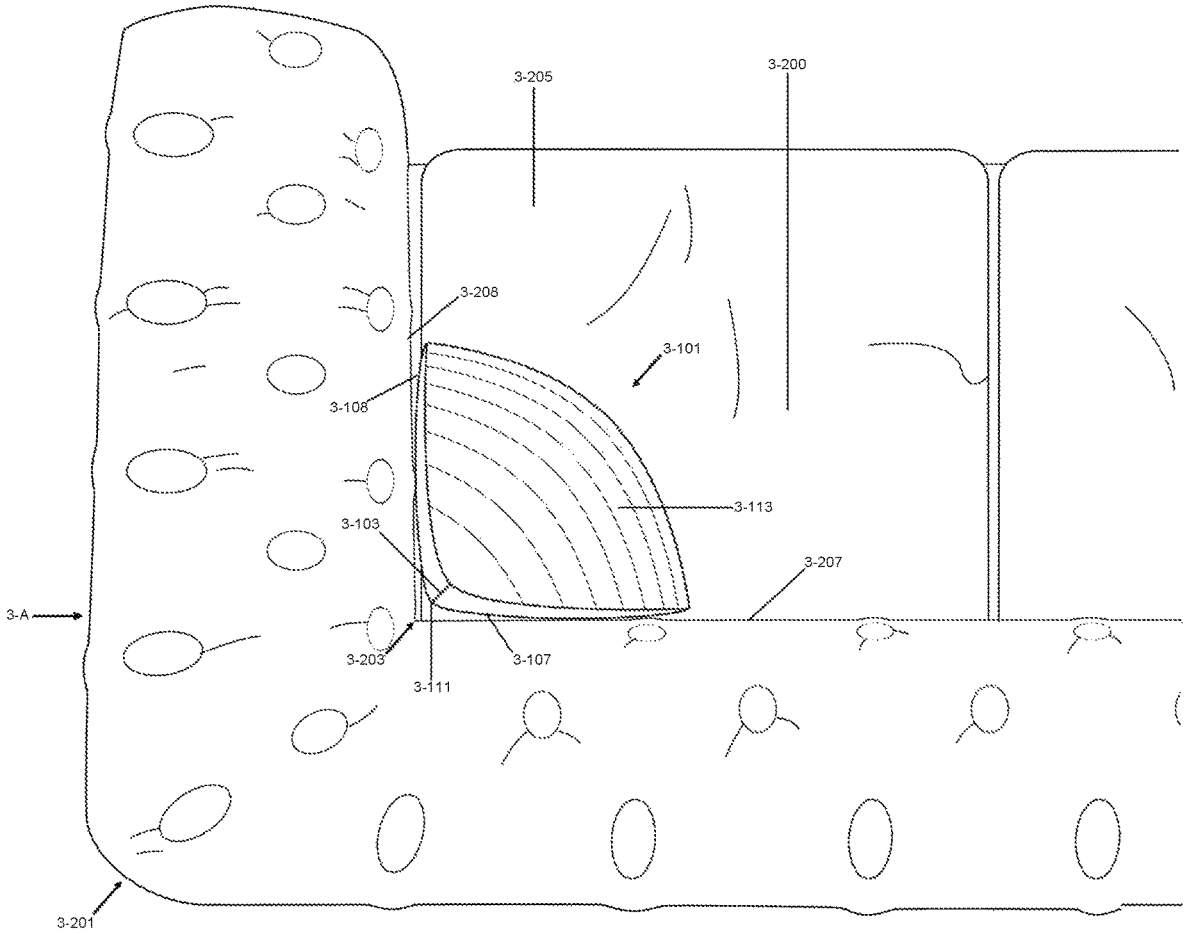
Fig. 3.2

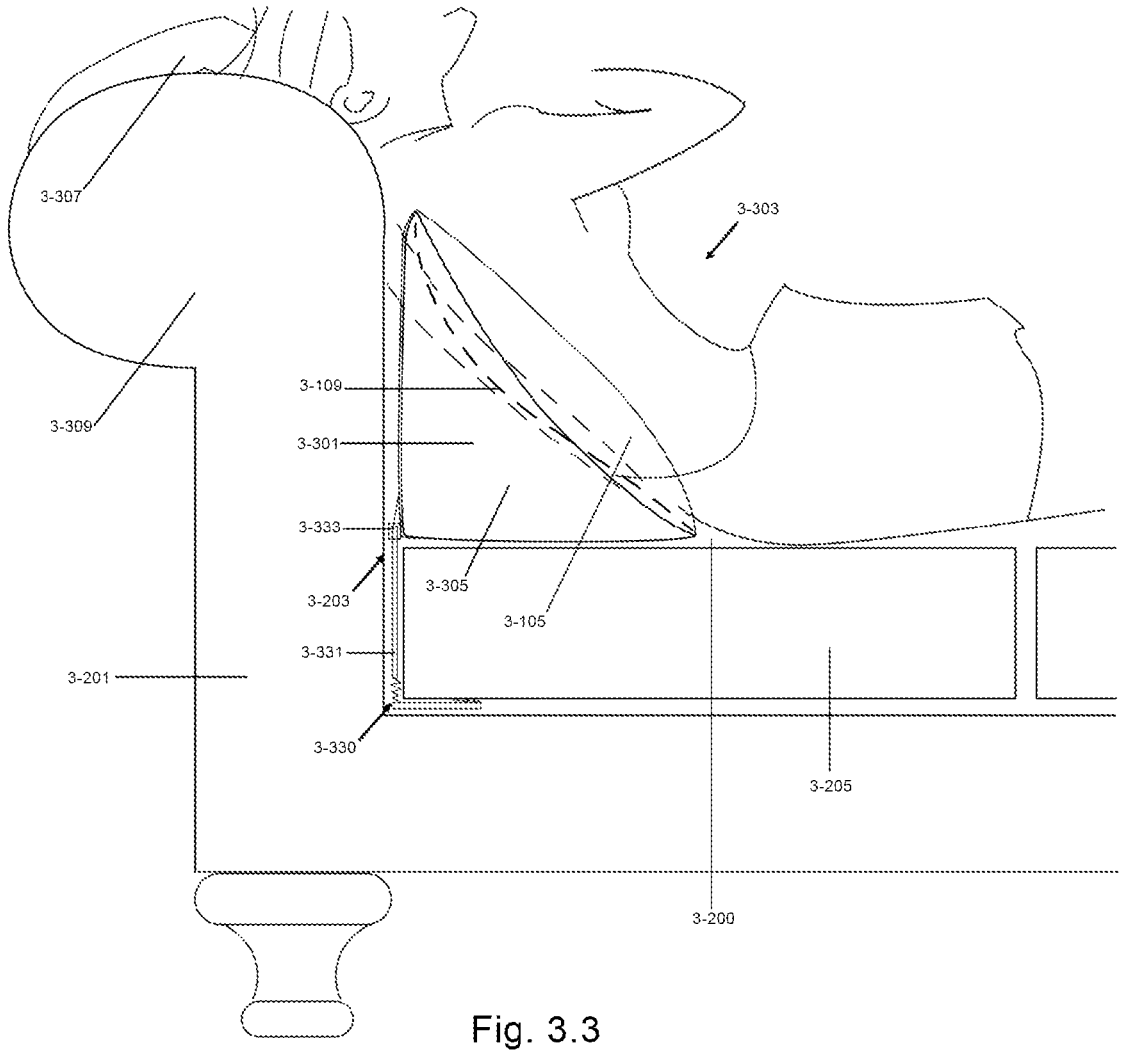
Fig. 3.3

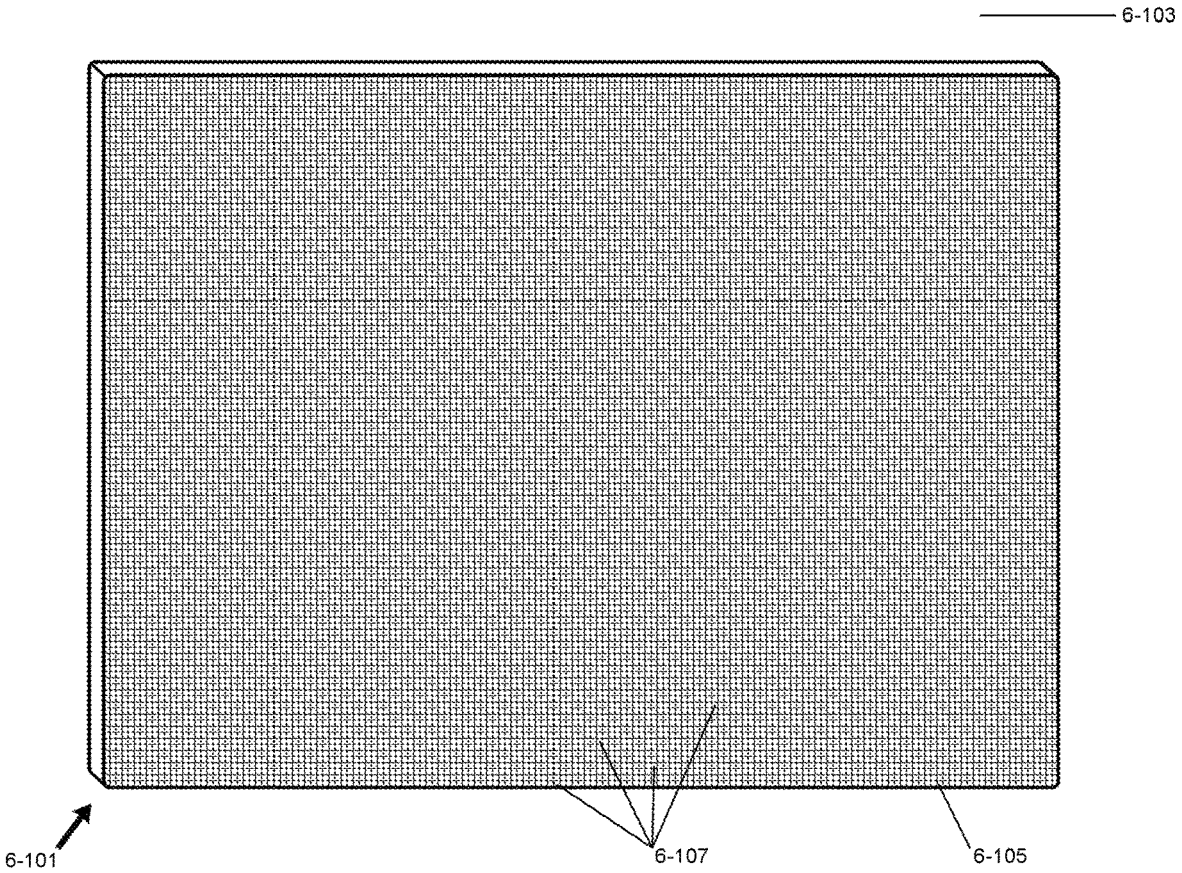
Fig. 6.1
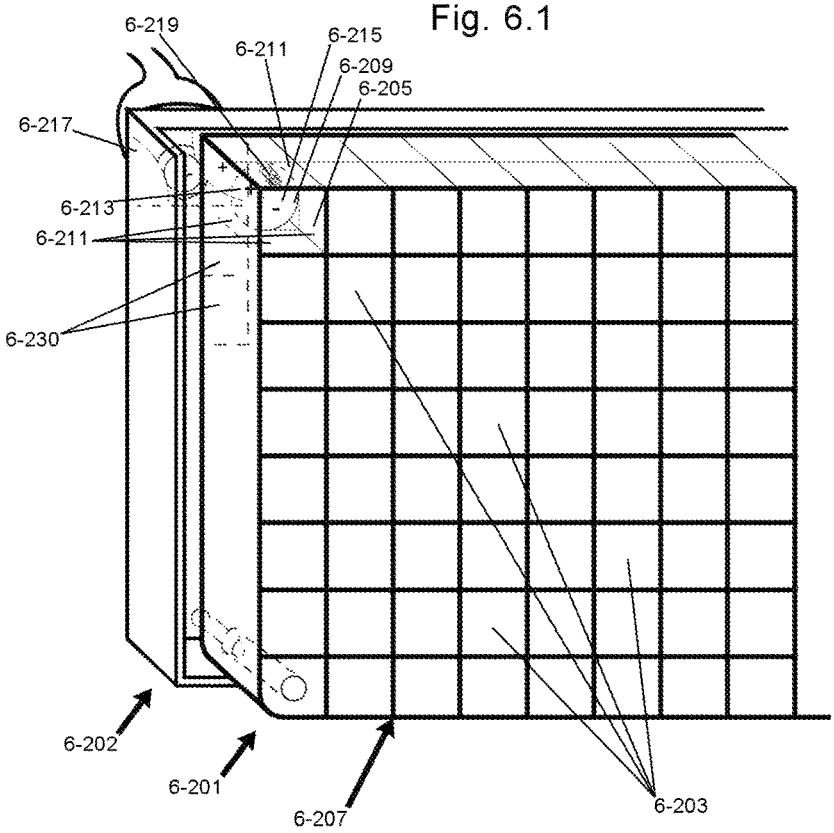
Fig 6.2

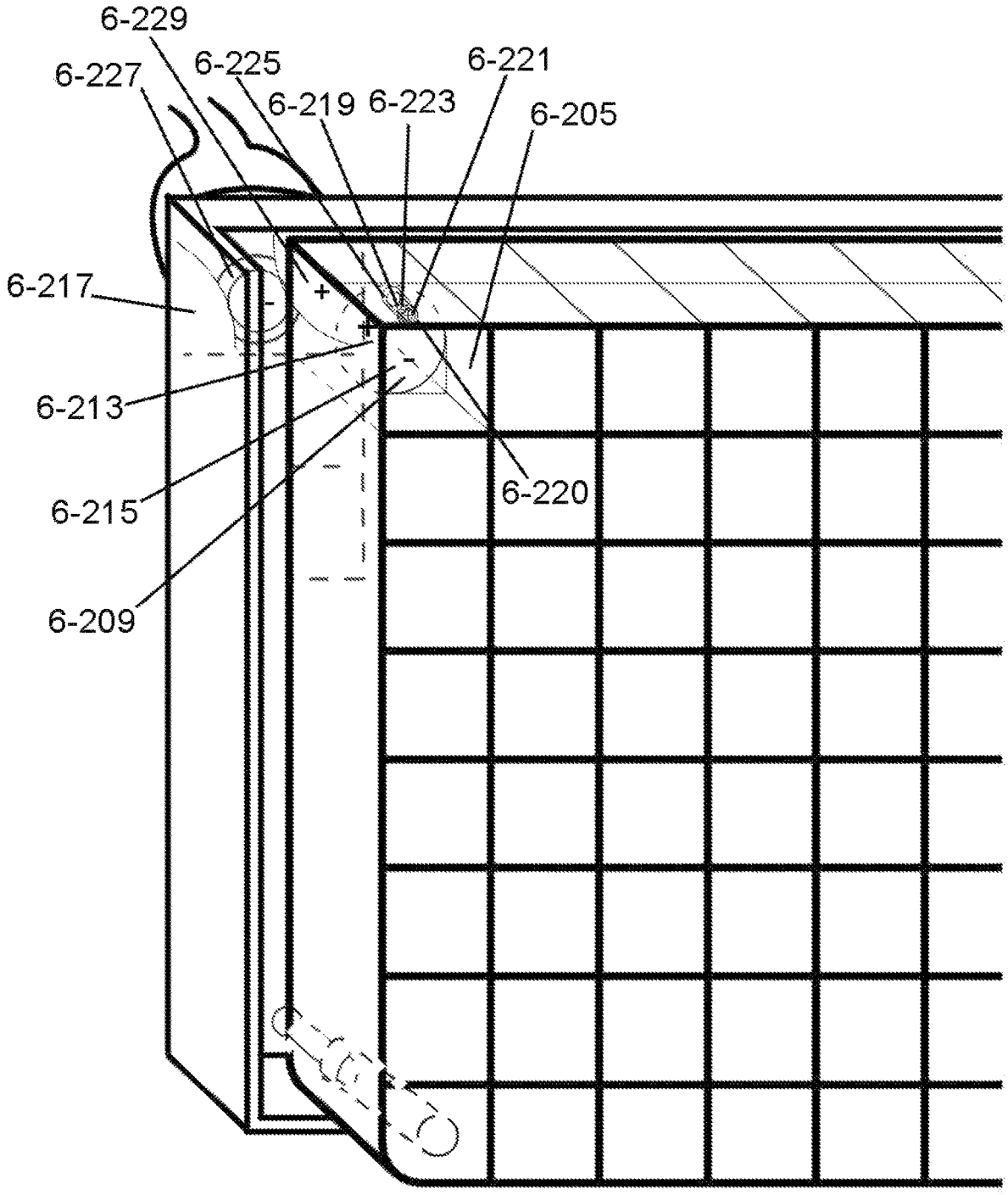
Fig. 6.3

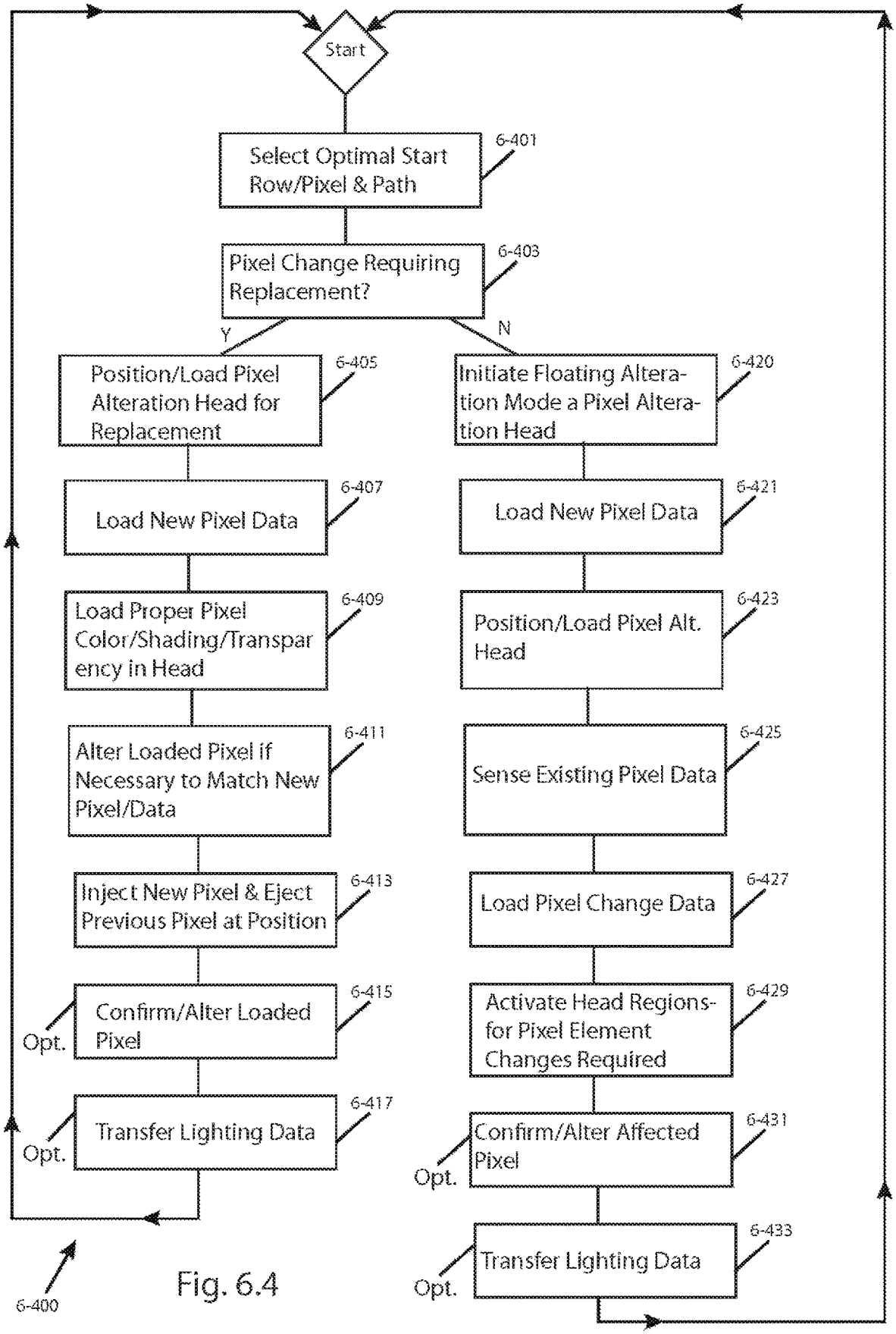
Fig. 6.4

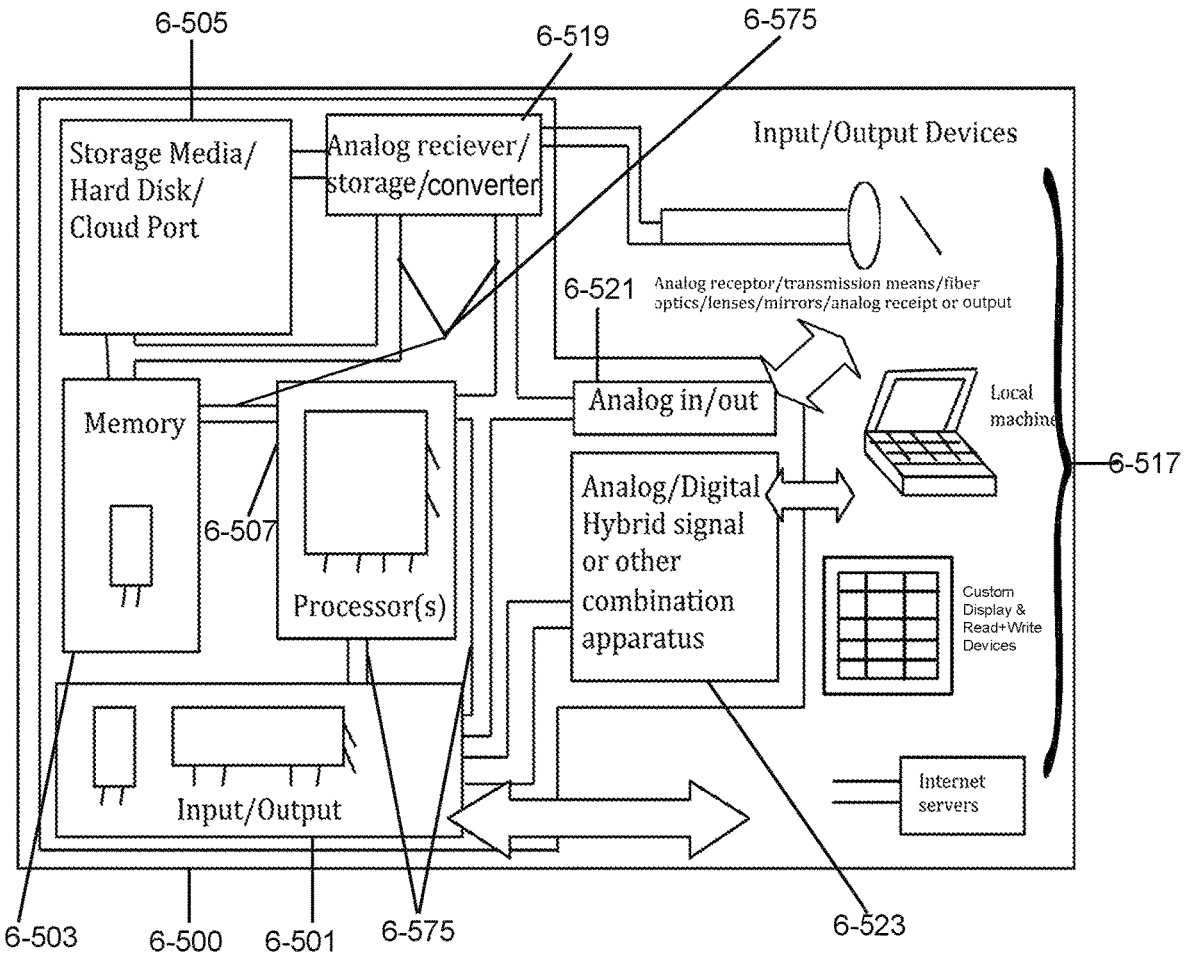
Fig. 6.5

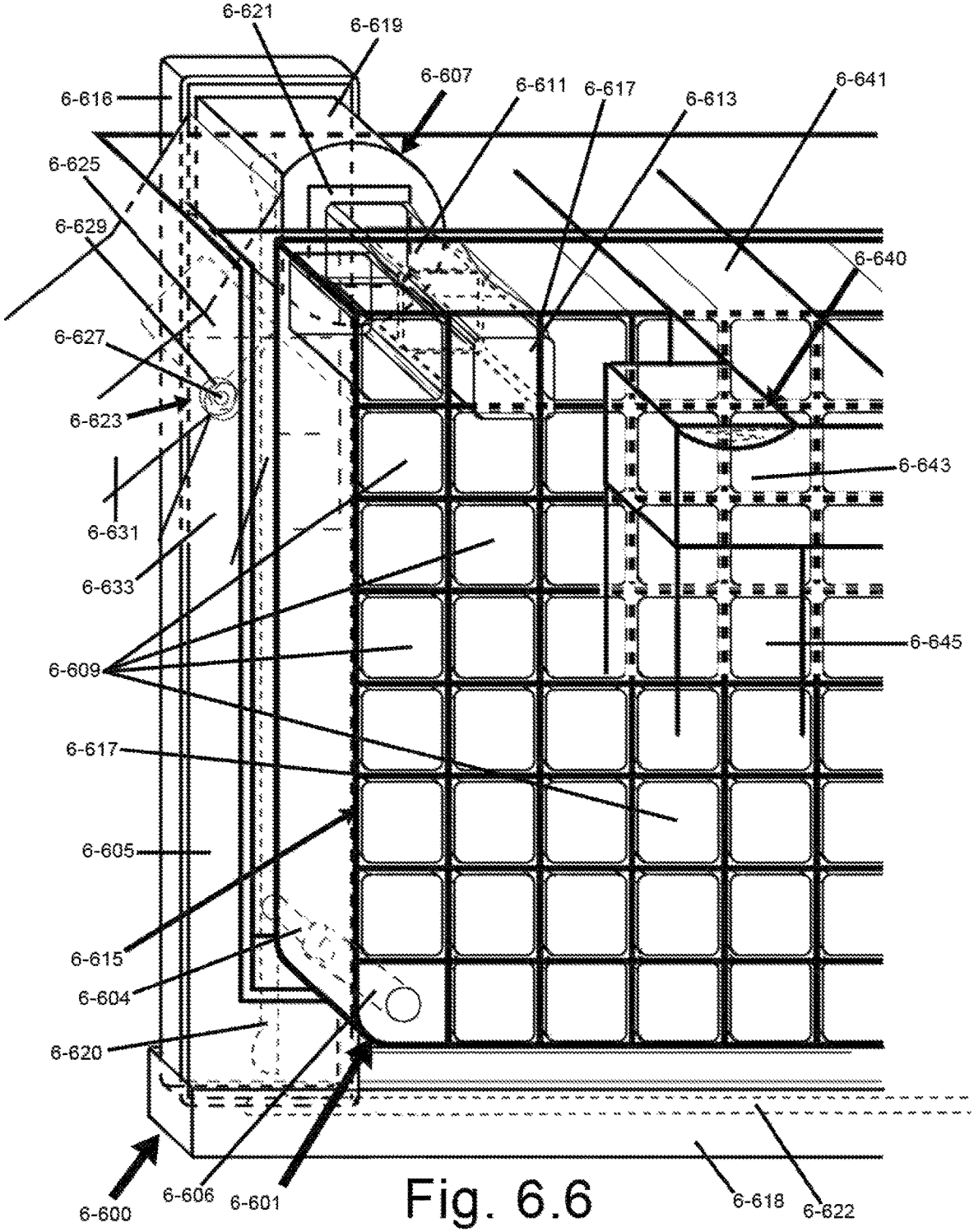
Fig. 6.6

DRINKING VESSEL AND ICE SUBMERSION TECHNIQUES

CROSS-REFERENCE TO RELATED APPLICATION

This application is a continuation of co-pending U.S. application Ser. No. 15/006,110, filed Jan. 25, 2016, entitled "Home and Lifestyle Improvements," which claims the benefit of U.S. Provisional Application No. 62/106,753 filed Jan. 23, 2015. The entire contents of each of the above applications are hereby incorporated by reference into the present application.

FIELD OF THE INVENTION

The present invention relates to the field of water treatment and delivery devices, and barware.

BACKGROUND

For time immemorial, humans have attempted to enhance their quality of life and environment. The invention disclosed in this application relates to a wide variety of new devices and methods for that purpose, including drinking vessel improvements. Humans have used vessels for drinking at least since the dawn of civilization. More recently, both heating and refrigeration were introduced, to control the temperature of consumable liquids. One long-used method of beverage refrigeration is to introduce ice into a drinking vessel, along with the consumed beverage, or to chill the drinking vessel, if a low-temperature beverage is desired.

It should be understood that the disclosures in this application related to the background of the invention, in, but not limited to this section titled "Background," do not necessarily set forth prior art or other known aspects exclusively, and may instead include art that was invented concurrently or after the present invention and conception, and details of the inventor's own discoveries and work and work results.

1. Summary of the Invention—"SubmerIce"

Methods and devices for enhancing drinking chilled drinking vessels are provided. In some aspects, a concentric set of arms or tabs in a pre-configured section of a drinking vessel applies holding pressure to expanded water poured within the section. A beverage is then poured over the frozen water, submerging it. In other aspects, holding pressure is maintained through flexible and/or adjustable arms, and lateral play eliminated, even if the frozen water melts. In other embodiments, a loop or set of loops extends from the center of the vessel above the section, and separate, flexible members (preferably cambered) are threaded through the loops after the water is frozen to apply greater holding pressure.

BRIEF DESCRIPTION OF THE DRAWINGS

FIG. 1.1 is a side view of an exemplary drinking glass comprising ice submersion aspects of the present invention.

FIG. 1.2 is a top view of an exemplary drinking glass, comprising additional ice submersion aspects of the present invention.

FIG. 1.3 is a side view of an exemplary drinking glass comprising additional ice submersion aspects of the present invention.

FIG. 1.4 is a top view of another exemplary drinking glass, comprising ice submersion aspects of the present invention.

FIG. 1.5 is a side view of an exemplary suction-driven mold for creating submerged ice and frozen solution ("ice") structures, in accordance with aspects of the present invention.

FIG. 1.6 is a side view depicting another exemplary drinking glass containing a mold and water or an aqueous fluid, and comprising ice submersion aspects configured to implement a mold.

FIG. 1.7 is a side view of another exemplary drinking glass comprising additional ice submersion aspects of the present invention, including an alternate form of grasping stalk.

FIG. 1.8 is a side view of three exemplary embodiments for insertable strips, which may be used with drinking vessels implementing aspects of the present invention.

FIG. 1.9 depicts exemplary box-shaped portals, which may be used in conjunction with other aspects of the invention related to grasping stalks.

FIG. 1.10 is a top view of an exemplary drinking glass, comprising ice submersion aspects of the present invention.

FIG. 1.11 is a side view of the same exemplary drinking glass discussed in reference to FIG. 1.7, above, with a user-installed infusing device locked on a grasping stalk, in accordance with aspects of the present invention.

FIG. 1.12 is an enlarged side view of the same user-installable infusing device set forth in FIG. 1.11, above.

FIG. 2.1 is a perspective view of an exemplary round soap bar comprising internal water flow and foaming aspects of the present invention.

FIG. 2.2 is a side view of the same exemplary round soap bar set forth in FIG. 2.1.

FIG. 2.3 is a perspective view of an exemplary soap bar held in a human hand, and implementing ergonomic optimization aspects of the present invention.

FIG. 2.4 is a bottom view of another exemplary soap bar implementing ergonomic optimization aspects of the present invention, and aspects of the invention related to internal water flow and foaming.

FIG. 2.5 is a bottom view of another exemplary soap bar implementing ergonomic optimization aspects of the present invention.

FIG. 2.6 is a bottom view of a unique exemplary combined soap bar, grooming and scrubbing brush, in accordance with aspects of the present invention.

FIG. 2.7 is a front view of an exemplary bubbleflow soap bar comprising internal water flow and foaming aspects and ergonomic and storage aspects of the present invention.

FIG. 3.1 is a side view perspective drawing depicting an exemplary corner-filling and body-conformed pillow, in accordance with aspects of the present invention.

FIG. 3.2 is a top view perspective drawing depicting the same exemplary corner-filling, body conformed pillow as discussed in reference to FIG. 3.1, and an exemplary couch in which pillow is installed.

FIG. 3.3 is a perspective view depicting another exemplary corner-filling and body-conformed pillow, in use by a human user on the couch set forth in reference to FIG. 3.2, above.

FIG. 6.1 is a perspective drawing of an exemplary unpowered programmable display device implementing aspects of the invention related to hanging art.

FIG. 6.2 is an enlarged perspective drawing of aspects of part of the same exemplary display device discussed in reference to FIG. 6.1, along with a temporarily-conjoined pixel-setting device.

FIG. 6.3 is an enlarged perspective view of aspects of the same exemplary display embodiment set forth in reference to FIG. 6.2, above.

FIG. 6.4 is a process flow diagram, illustrating exemplary steps that may be carried out by a control system (such as the control system set forth in FIG. 6.5, below) implementing aspects of the present invention related to displaying images using a display device (such as the display devices discussed above).

FIG. 6.5 is a schematic block diagram of some elements of an exemplary control system that may be used in accordance with aspects of the present invention.

FIG. 6.6, another form of pixel setting device, serially addressing, reading and writing viewable display pixels according to aspects of the present invention, is illustrated.

DETAILED DESCRIPTION OF THE INVENTION

Figure 4:
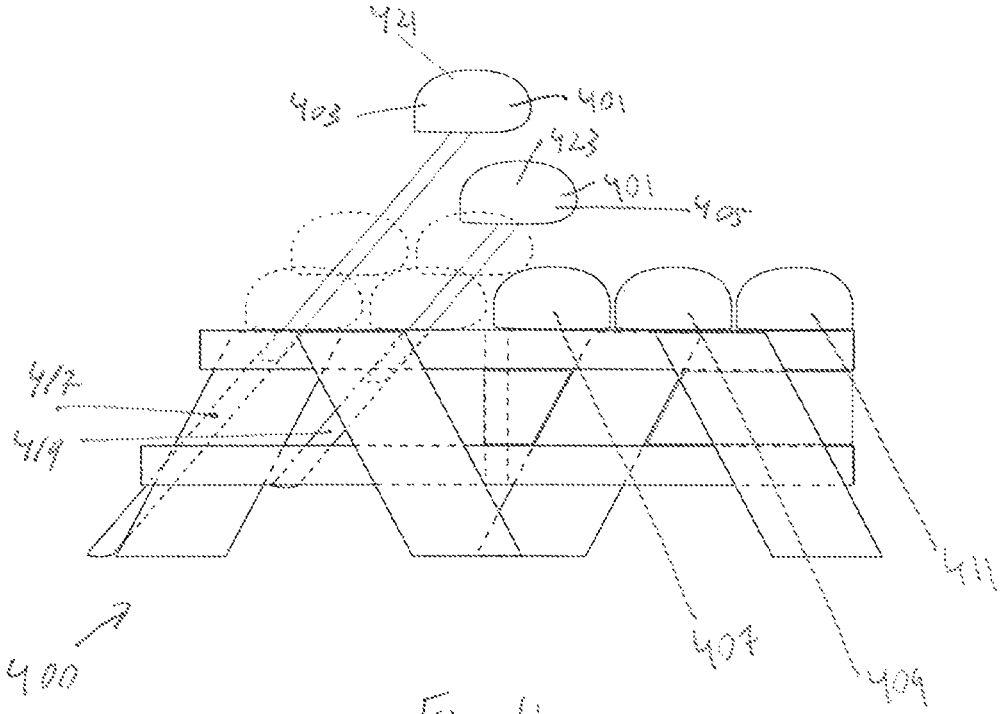
FIG. 4 is a side view of an exemplary couch with modular, standardized raisable user-support sections, in accordance with aspects of the present invention.

FIG. 1.1 is a side view of an exemplary drinking glass 1-101 comprising ice submersion aspects of the present invention. It should be noted that, while the example of frozen water ("ice") is used, a wide range of cooling media known to persons skilled in the art may be used in place of ice, in many embodiments where it is implemented, below. Drinking glass 1-101 is generally cylindrical in shape, appearing roughly rectangular from a side view, as pictured, and comprises waterproof walls 1-103 and a waterproof bottom 1-105. Glass 1-101 comprises an open, circular hole at its top 1-107, however, permitting fluids to be poured into, and confined within, it with the aid of gravity, and poured out of it by tipping glass 1-101 (for example, against a user's lips to consume a fluid poured out of glass 1-101 through open top 1-107). On the upper surface, and connected to the center of bottom 1-105 is a grasping stalk 1-109, which comprises a central column 1-111 and flexible or compressible arms 1-113.

Compressible arms 1-113 preferably can be conformed to several different positions (as pictured), depending on user actuation and surrounding environmental factors. For example, preferably, arms 1-113 are flexible, but biased toward a resting conformation, at room temperature and under the influence of gravity at the surface of the Earth, at the position pictured as 1-115, in which the distal tips 1-117 of arms 1-113 rest just above or at the surface of a fluid 1-118 that is filling glass 1-101 to a first marked glass-filling level—noted by a liquid water level marker 1-119 etched in glass 1-101. Water level marker 1-119 allows a user to fill glass 1-101 to an appropriate level with an aqueous fluid to cause other aspects of the invention can operate, as will be discussed in greater detail below.

After filling glass 1-101 with an aqueous fluid (such as water) 1-118 to the level indicated by etched marker 1-119 (as pictured) a user may then place glass 1-101, and the aqueous fluid held within it, into a freezer, or otherwise subject them to temperatures low enough to freeze aqueous fluid 1-118. Preferably, when so placed in a freezer, or otherwise subjected to freezing temperatures, the resulting decreased temperatures progress from the upper regions of fluid 1-118, due to the open top 1-107, which permits freezing temperatures to reach the upper surface and other upper regions of fluid 1-118 prior to lower regions of the fluid 1-118, as glass 1-101 is cooled, because walls 1-103 and bottom 1-105 serve as an insulator, slowing the cooling of those lower regions, relative to those upper regions. As the upper regions of fluid 1-118 freeze and solidify, they also expand in volume, owing to the higher volume of water and other aqueous fluids when frozen. As a result, the solidified upper surfaces of fluid 1-118 also begin to extend upward, and exert an upward force on arms 1-113, moving it from resting conformation position 1-115 to a raised, extended position (shown in later figures). That upward force increases as the fluid occupies more and more volume during freezing. Because arms 1-113 are flexible, but biased toward lower position 1-115, there is a resulting pressure between frozen fluid 1-118 and arms 1-113, creating an ice-gripping and -holding effect. In some embodiments, arms 1-113 and their tips 1-117 have a lower resting conformation and position than that pictured at colder than water-freezing temperatures, such that the resulting holding and securing pressure between arms 1-113 and frozen fluid 1-118 is increased further after fluid 1-118 is frozen, when glass 1-101 and its gripping stalk's arms 1-113 reach lower-than-water-freezing temperatures after fluid 1-118 is frozen. This aspect prevents tips 1-117 from dipping into fluid 1-118 before it is frozen, while increasing the holding and securing pressure after it is frozen. To encourage this lower position and conformation, a metal with a high coefficient of contraction with lowering temperatures may be used in a contracting region(s) 1-121, on the ventral/lower sides of arms 1-113 and within central column 1-111. Conversely, or in addition, a material with a low coefficient of contraction or even a material that exhibits expansion with lowering, sub-freezing temperatures may be used in the remaining (upper/dorsal) sections of arms 1-113. Several known materials exhibit these thermal contraction and expansion characteristics, as will be readily apparent to those of ordinary skill in the art. For example, iron and stainless steel exhibit thermal contraction at temperatures descending below the freezing point of water and many aqueous solutions. Materials known to exhibit thermal expansion with lowering temperatures include many rubbers and metal alloys such as cubic $ScF_3$ and $ZrW_2O_8$. In a preferred embodiment, contracting region 1-121 and column 1-111 comprise iron or stainless steel, and the upper arm regions comprise a rubber. Preferably, as a result of employing materials and configurations in accordance with the techniques discussed above, a resting conformation for arms 1-113 does not descend lower than the level of fluid level 1-118 until temperatures below the fluid's freezing point occur within (or within the majority of) arms 1-113 and/or column 1-111.

Preferably, column 1-111 itself is also length-adjustable and/or flexible (stretchable and compressible) to aid in creating the force-applying, ice-gripping and -holding effect, discussed above, in addition to or as an alternative to arms 1-113 being flexible and applying holding and securing force to frozen aqueous fluid 1-118. Thus, as with arms 1-113, column 1-111 may comprise a material or materials with resilient, elastic or other spring or force-biasing properties (such as flexible plastic and/or metal). As with contracting regions 1-121, column 1-111 may also comprise a material with a high coefficient of contraction with lowering, freezing (sub-zero degrees C.) temperatures, for the same reasons set forth with respect to contracting regions 1-121, above. To further aid in the application of holding and securing force, a tightening tab 1-123 is also provided in some embodiments. Tightening tab 1-123 may create and increase the downward, holding and securing force by pulling an inner column 1-125, which is connected to arms 1-113, downward. For example, by twisting tab 1-123 clockwise (when viewed from bottom, in the perspective of the figure), column 1-125 (attached to tab 1-123) also twists clockwise within the housing of 1-111. Due to threading 1-127 on the surface of inner column 1-125, which engages with the housing of 1-111 (and, in some embodiments—not pictured, for simplicity) complementary, female connector threading lining it), that twisting motion results in downward movement of column 1-125. In a preferred method, a user may first subject glass 1-101 and fluid 1-118 (filled to level indicator 1-119) to freezing temperatures until fluid 1-118 is fully frozen. At that point, the aqueous fluid may occupy a greater space, up to frozen level indicator 1-120 (which corresponds to roughly 9% greater volume than the fluid prior to freezing, as may occur with water and frozen aqueous fluids). The user then withdraws glass 1-101 from the freezing conditions, for use, and applies additional holding and securing force, by twisting tab 1-123, as discussed above. Positive stops or a reversible ratchet may be used with tab 1-123, to secure the desired holding force. In some embodiments, a torque-limiting device may also be included, preventing tab 1-123 from exceeding a pre-determined securing force.

Also, or alternatively, to aid in the application of securing and holding force, arms 1-113 may be user switchable, between two alternative resting conformations: (1) a raised position 1-127, in which the tips 1-117 are well clear of fluid level 1-118, and (2) a lowered position (not pictured, for simplicity) but in which tips 1-127 would match or descend even lower than position 1-115 if not for an intervening frozen fluid, due to natural force-biasing and form of the material (e.g., an elastomeric material and form biased toward two resting conformations). Thus, with arms 1-113 in position 1-127, and as with the method discussed above related to tab 1-123, a user may first freeze aqueous fluid 1-118 by placing glass 1-101 and the fluid within it into a freezer, and then withdraw the glass and fluid once fully frozen (or at an even lower, predetermined temperature). The user may then apply enhanced holding pressure, in accordance with other aspects discussed above and, in addition, by pushing arms 1-113 until they reach an intermediate pivoting position (the stretched, fully loaded balancing point between the two resting conformations) in which they experience a force biasing (e.g., spring effect) toward resting conformation 2, rather than conformation 1. Using this method and device embodiment, a greater holding force may be secured, with fewer moving parts than other embodiments.

FIG. 1.2 is a top view of the exemplary drinking glass 1-101 comprising ice submersion aspects of the present invention. From this view, the generally cylindrical glass 1-101 has a round profile, as does central column 1-111 of grasping stalk 1-109. As can now be seen, arms 1-113 are preferably outwardly-tapered members, as pictured, connected to central column 1-111. However, it should be understood that a wide variety of alternative shapes and conformations may be implemented, while still carrying out aspects of the present invention. For example, in some embodiments, a single, round ridge, tab or member, capping column 1-111 and extending from it at the same position as arms 1-113, may instead be used. Such a ridge (not pictured) may also be composed of an elastomeric material with multiple resting conformations, and force biasing encouraging folding in either conformation, creating downward (into the page, in the perspective of this figure) holding and securing force when pushed downward, past a fulcrum position (with materials of the ridge stretched and loaded with a maximum spring potential energy) between the two conformational positions.

Other forms of ice-holding ridges and tabs—some of which line walls 1-103, rather than central column 1-111, are also covered, in reference to additional figures, below.

FIG. 1.3 is a side view of an exemplary drinking glass 1-301 comprising ice submersion aspects of the present invention. Glass 1-301 is identical to glass 1-101, with the omission of certain features, and illustrating a resting position 1-331, discussed above, but not pictured in FIG. 1.1, when glass 1-301 and aqueous solution 1-118 within it, have been subjected to freezing or lower-than-freezing temperatures. As discussed above, in a resting conformation at room temperature, arms 1-313 are ordinarily in a position 1-115 (unless they encounter an intervening obstacle, such as frozen fluid. Also as discussed above, when subjected to lower than freezing temperatures, arms 1-313 may become biased toward an even lower position below 1-118. Resting position 1-331 results, however, from the collision of the tips 1-317 of arms 1-313 against the upper surface of aqueous fluid 1-118 when it has been frozen. Once frozen, as pictured, water or aqueous solution 1-118 occupies a higher position than when in liquid form, with a height level indicated by frozen level marker 1-120 (now 1-320). As a result, arms 1-313 are stressed upward from their resting conformation by colliding with frozen water or aqueous solution 1-118, resulting in the application of a holding and securing force between arms 1-313 and water or solution 1-118.

Once in the condition set forth in FIG. 1.3, a user may proceed to a use step in which he or she pours an additional fluid into open top 1-307 of glass 1-301, where it will occupy the space directly above frozen water or fluid 1-318, and be chilled by it. As thermal energy may be transferred from the surrounding environment to frozen fluid 1-318, it may begin to melt, and its volume will decrease. However, even as substantial volume is lost in frozen block 1-318, arms 1-313 will continue to apply a holding and securing force on it, preventing its movement, because they are biased toward an even lower resting position than that pictured, as discussed in various embodiments above.

FIG. 1.4 is a top view of another exemplary drinking glass 1-401, comprising ice submersion aspects of the present invention. Drinking glass 1-401 differs from glass 1-101 as pictured in FIG. 1.2 in the number of frozen water- or solution-holding arms 1-118. In the embodiment pictured in this figure, there are now 3 frozen water or solution-holding arms 1-418, in a radially symmetrical pattern, rather than a bilaterally symmetrical pattern. In all other respects, arms 1-418 may be substantially identical to embodiments set forth above for arms 1-118. This different configuration results in some additional stability in frozen water and solution holding, albeit at the potential cost of more materials (although, not necessarily so).

FIG. 1.5 is a side view of an exemplary suction-driven mold 1-501 for creating submerged ice and frozen solution ("ice") structures, in accordance with aspects of the present invention. Mold 1-501 comprises a housing 1-503 and interior hollow areas 1-505. In methods implementing mold 1-501 in accordance with aspects of the present invention, mold 1-501 is first inverted (reversing the vertical orientation pictured in the figure) and water or an aqueous fluid is poured into it, through open bottom 1-507. A specialized glass, such as any of the glasses discussed in reference to FIGS. 1.1-1.4, above, is then also inverted, and placed over mold 1-501, pressing bottom 1-507 against the interior bottom of the glass, creating a water-tight seal between them by pressure. An elastomeric gasket or 0-ring (not pictured) may line the lower surface of bottom 1-507 to enhance that seal. Both the mold 1-501 and the glass are then inverted again (to the orientation pictured in FIG. 1.6, discussed below), with gravity and air pressure maintaining the water-tight seal, and the glass may then be filled with additional water or aqueous fluid, until a fluid fill line is reached by the upper surface of the water or fluid. Mold 1-501 may then be raised into a locked position, with the aid of tabs 1-541, as will be shown in greater detail with reference to FIG. 1.6, below.

FIG. 1.6 is a side view depicting another exemplary drinking glass 1-601 containing mold 1-501 and water or an aqueous fluid 1-618, and comprising ice submersion aspects configured to implement mold 1-501. As discussed above, when glass 1-601 has been filled with water or an aqueous solution up to fluid marker, shown as 1-619, and mold 1-601 is filled with such water or solution and held with its bottom 1-507 submerged under marker 1-619 and the surface of water or solution held in glass 1-601, mold 1-501 may be raised to the position pictured, without releasing any water or fluid from mold 1-501. The position pictured is maintained, in part, by holding tabs 1-641. Holding tabs 1-641 also, or alternatively, may serve to hold fluid 1-618 in place and, as with arms 1-113, discussed above, may comprise a flexible or force-loadable material—which may also comprise regions that contract and/or regions that expand with decreased sub-zero temperatures, that cause the lower tips 1-617 of tabs 1-641 to descend to a lower resting conformation and position at lower than freezing temperatures. In this way, as the water or solution 1-618 freezes, and the level rises to a second, frozen marker 1-620, an ice- or other frozen fluid-holding or -securing effect occurs, as occurs with arms 1-113, above under such conditions, and with all of the same benefits. In some embodiments, a central gripping stalk of glass 1-601—shown as 1-609, and substantially identical to holding stalks discussed elsewhere in this application—may be omitted, and tabs such as 1-641 may be used exclusively, or both central stalk 1-609 and tabs 1-541 may be used simultaneously, as in the embodiment pictured. However, if used, stalk 1-609 preferably fits within, and is preferably fully accommodated by, inner hollow 1-606 of mold 1-501 at all stages implementing the methods discussed above. Supporting and position-guiding tabs or ridges 1-541 may be included at the edges of mold 1-501, and may rest on tabs 1-641 at the position shown, such that a user may raise mold 1-501 to that position, and leave it in that position (necessary to maintain a seal between bottom 1-507 and the surface of the water or solution held in glass 1-601, for freezing, while permitting the later release of mold 1-501, after freezing). A user may then place glass 1-601, and the water or solution and mold 1-501, held within it, in a freezer, or otherwise may subject them to lower than freezing temperatures, causing all of the held water or solution to freeze into a form defined by the outline of the glass and the inner hollows of the mold 1-501. A user may then pull off mold 1-501, due to its flexible composition (e.g., silicone or plastic), and then pour an additional fluid over the formed ice structures to cool it for consumption.

The ice structures created by the mold pictured are exemplary, not exhaustive of the many alternative structures that may be formed in accordance with the present techniques. The structure pictured provides a balance between beverage-cooling and structure maintenance (e.g., melting resistance), with a large effective surface area created by several mold towers 1-645. These towers 1-645 may be columnar, box-shaped, or any other 3-dimensional shape (with an open bottom, allowing the movement of fluids and frozen objects into empty, interior spaces 1-505. In some embodiments, towers 1-645 may be omitted, or other shapes (or fewer or more instances of shapes, of larger or smaller dimensions) may be included or interposed in their place (e.g., a corporate logo, or famous structure). Virtually any functional or ornamental moldable structure may thus be created, held fast at the base of glass 1-601, and submerged in a beverage. A user drinking the beverage may then view and appreciate those structures (e.g., through transparent glass materials, such as glass, or through the open top of the glass).

FIG. 1.7 is a side view of another exemplary drinking glass 1-701 comprising additional ice submersion aspects of the present invention, including an alternate form of grasping stalk, 1-709. As with exemplary drinking vessels discussed earlier implementing aspects of the present invention, drinking glass 1-701 comprises waterproof walls 1-703 and a waterproof bottom 1-705, while also comprising an open top 1-707, into (and out of) which fluids (such as beverages) may be poured. In addition, and also as with other exemplary drinking vessels set forth in the present application, drinking glass 1-701 may also comprise a water level marker 1-719, and a corresponding frozen water or fluid level marker 1-720 (matching the level of the resulting ice level within glass 1-701 when liquid water 1-718, at the level indicated by marker 1-719, is frozen. However, unlike some other embodiments set forth in the present application, grasping stalk 1-709 further comprises insertion portals 1-771 through it, preferably at a position substantially vertically above both water line 1-719 and frozen water level marker 1-720. Insertion portals 1-771 preferably are each substantially cylindrical tunnel-shaped, and pass completely through stalk 1-709 horizontally. Also preferably, insertion portals 1-771 are also preferably positioned such that their cylindrical tunnel-shapes are perpendicular to one another. As a result, when sticks, pins or strips ("strips") are threaded through both portals 1-771, they approximately form an "X" shape. This resulting X-shape formation of strips serves to stabilize a frozen block of ice or aqueous fluid, resting below them, in multiple areas and directions.

It should be understood that, although the example of two insertion portals, in and over/under and rotated 90 degrees from one another, permitting pliable strips, such as 1-873, to be inserted in an X-shape formation, is provided in the present figure for exemplary purposes, fewer, more, or different orientations, spaced differently vertically, horizontally or at different spaced rotations (other than perpendicular to one another), and different degrees of insertion portals and strips may be used, in a wide variety of possible embodiments carrying out aspects of the present invention.

In a preferred method implementing glass 1-701, a user first fills glass 1-701 with water or an aqueous fluid 1-718, through open top 1-707, until the water or aqueous fluid 1-718 reaches a level corresponding with water level marker 1-719. A user then places glass 1-701, containing fluid 1-718, into a freezer or otherwise subjects them to lower than freezing temperatures. The user then permits sufficient time to pass to thoroughly freeze fluid 1-718, converting it to a solid state. Fluid 1-718 expands during the freezing process, approximately until it occupies space at the bottom of the glass up to frozen level marker 1-720. (It should be noted that, in some embodiments, marker 1-720 and/or marker 1-719 may be omitted, because a user may use another landmark, such as aspects of stalk 1-709, as a guide for fluid filling levels, and a frozen fluid level may be omitted.) A user then introduces and inserts at least one strip (and, preferably, two strips—one into each portal) into portals 1-771, above the frozen water or aqueous fluid ("ice"), which hold it at the bottom of glass 1-701. As will be shown in greater detail, below, the strips are preferably flexible and cambered, such that their tips press downward into the ice once inserted, exerting a holding and stabilizing force onto the ice, while also being readily insertable into portals 1-771. Also, as the ice melts, and loses volume, the strips' bias toward the bended form shown in FIG. 1.8 permits the tips to descend, while still exerting substantial downward holding and stabilizing force on the ice.

FIG. 1.8 is a side view of three exemplary embodiments for insertable strips 1-801, which may be used with drinking vessels implementing aspects of the present invention, such as glass 1-701, set forth above. As discussed in greater above, a user may insert any of strips 1-801 into any of ports 1-771, above frozen fluid 1-718, and hold it in place. Each of strips 1-801 is shown in its natural, unstressed physical conformation, and exhibits a curvature, in which the ends of the strip are lower than their center. For example, beginning with exemplary insertable strip 1-803, its tips 1-805 are at a substantially lower vertical position than its center 1-807. This natural curve can be carried out by cutting strip 1-803 from a block of parent material in that shape, or by later deformation and molding a straightened strip of material into the curved resting shape and conformation pictured. For example, if strips of wood (e.g., sustainable bamboo) are used, a straight strip may be created by inserting it into a curved vice (which temporarily creates the curved shape, or an even more greatly curved shape) and then subjecting it to heating, moisture and other environmental conditions, resulting in remodeling the strip into the curved shape pictured, once released from the mold.

A wide variety of flexible, spring materials may be used in manufacturing strips 1-801. As mentioned above, flexible woods, such as bamboo, may be used, or a culinary-grade flexible polymer (e.g., PET or other plastics) may be used. In any event, the material(s) chosen preferably allows either end of any of strips 1-801 to be inserted into either portal 1-771, while flexing (and decreasing in curvature)—without permanent deformation—to fit completely above frozen water or aqueous fluid 1-718. Because strips 1-801 are not permanently deformed, and are then anchored in stalk 1-709 (which is anchored to or integral with the bottom 1-705 of glass 1-701), and because strips 1-801 are flexible leaf springs, they will then exert a downward force onto frozen fluid 1-718, anchoring it to the bottom of glass 1-701—even after being immersed in another, non-frozen fluid poured into glass 1-701 above it, in which frozen fluid (then ice) 1-718 would otherwise float. If tips 1-805 are not single-pointed (e.g., if they have a flat edge), and/or if center 1-807 is wider but compressible and insertable into either of portals 1-771, strip 1-803 may be fixed in rotation, and will not rotate (e.g., top surface 1-808 of strip 1-803 will remain facing upward if inserted facing upward) when pressing into frozen fluid 1-718, and will resist escape from central insertion (central insertion being with center 1-807 placed within and at or near the center of portals 1-771). However, in some embodiments, additional aspects further encourage the maintenance of central insertion, and further fix the rotation of strips 1-801.

For example, strip 1-813 further comprises central insertion locking ridges 1-809. Locking ridges 1-809 are preferably mounds or rings of the same material comprised in strip 1-813 generally (which may be any of the materials discussed above for strips 1-801.) In some embodiments, however, a different, even more flexible and compressible material is comprised in ridges 1-809. Due to the compressibility and flexibility of the material comprised in strip 1-813, any of ridges 1-809 may be squeezed into and through either of portals 1-771. However, due to their resilience and rebound of ridges 1-809, once inserted and threaded through and emerging on the other side of the portal, ridges 1-809 will again expand, and apply a holding force (along with the ridge or ridges on the other side of strip 1-813, that was not inserted, on the other side of the portal) on the portal through which it was inserted and threaded. As another example, strip 1-823 comprises flat outer surfaces, creating a generally rectangular cross-section if bisected vertically at center 1-827. Outer lengthwise edges 1-829 then interface with portals 1-771, or, preferably, a rectangular box-shaped variation of portals 1-771, such as those shown as exemplary portals 1-971, in FIG. 1.9, and edges 1-829 lock the rotation of strip 1-823 once centrally inserted into such portals. For clarity, FIG. 1.9 depicts only the stalk 1-909 and bottom 1-905 of a glass or other drinking vessel, such as glass 1-701, in otherwise the same side view perspective as FIG. 1.7, above.

FIG. 1.10 is a top view of an exemplary drinking glass 1-1001, comprising ice submersion aspects of the present invention, including stalk 1-909 with two ice-stabilizing and -holding strips (strips 1-823) inserted into it. As discussed above, with two strips (1-823) inserted into a central stalk, through portals perpendicular to one another, and in an over/under configuration, such as 1-971, a resulting X-shaped formation results—in which the tips of strips 1-823 bear into frozen fluid 1-1018, below them (into the page, in the perspective of the figure) in different, spaced out areas, enhancing the stability of frozen fluid 1-1018 along multiple axes. That formation is illustrated, from the top view, in FIG. 1.10.

FIG. 1.11 is a side view of the same exemplary drinking glass, 1-701, discussed in reference to FIG. 1.7, above, with a user-installed infusing device 1-1101 locked on grasping stalk 1-709. Infusing device 1-1101 comprises an inner chamber 1-1103, in which a user may place any of a wide variety of food, flavor enhancing or temperature controlling items, and have them subjected to fluids held within glass 1-701 for consumption, via semi-permeable outer screen 1-1104. To place such items within chamber 1-1103, a user may remove a top section 1-1105 of device 1-1101, opening the top side of the chamber. Ergonomic flattened grips 1-1107, including gripping ridges 1-1109, of top section 1-1105 aid the user in unscrewing or otherwise unlocking it from the remainder of device 1-1101. In some embodiments, a user may alter the amount of screening by outer screen 1-1104, by shifting multiple screen layers relative to one another using grips 1-1107, one of which screen layers may be attached to the grips, and slidingly engaged with the other layer. By thus twisting and repositioning the two layers next to one another, holes in each of the screens may be selectively blocked or opened by causing them to abut solid bands or holes of the neighboring screen, respectively, to different degrees. Preferably, the amount of opening and blocking is indicated to a user with a visible GUI. In some embodiments, an actuator 1-1108 and control system 1-1110 connected with or otherwise comprising the actuator within device 1-1101, may affectuate that opening and closing of screen elements. Furthermore, that control system may comprise sensors 1-1116, both inside and outside of chamber 1-1103, for determining the amount of dissolved particles or other liquid attributes in liquids at both locations, and determine whether to more greatly open or close screen 1-1104 to achieve a desired (e.g., pre-programmed) beverage state. An example of such a control system is provided in FIG. 6.5, below.

A channel 1-1111 at the bottom of device 1-1101 fits the grasping stalk 1-709 of glass 1-709, and interlocks with it, via spring-loaded tabs 1-1113, which penetrate and snap into the portals 1-771 of the grasping stalk. Interlocking ridges 1-1115 also interlock with the outer contours of the portals 1-771, further securing device 1-701 to the base of glass 1-701.

If a user later wishes to release infuser 1-1101 from the base of glass 1-701—for example, for cleaning each of them—a finger-actuable release tab 1-1117 is included, with is connected to a sloped internal member 1-1119. By driving the tab and member downward, a complementary sloped side connected with at least one of tabs 1-1113 is driven outward, releasing the tab(s) from stalk 1-709.

2. Waterflow Soap

Abstract/Summary

A bar soap with specialized channels, permitting the internal flow of water and increased foaming and suds during use with an external source of flowing water. The channels comprise specialized profiles, aeration and agitation ridges and streamlining, to increase sudsing and foam. The inner shape of the channels also comprises a profile that narrows toward the central mass of the soap, such that the channels are better maintained throughout the lifetime of the soap bar. In some embodiments, new ergonomic shapes, better implementing the internal water flow, and better fitting a user's hand throughout the lifetime of wear for the bar soap, are also provided.

FIG. 2.1 is a perspective view of an exemplary round soap bar 2-101 comprising internal water flow and foaming aspects of the present invention. From the perspective of the figure, the generally coin-shaped body of bar 2-101 can be seen, and its generally round face 2-103, and an outer edge 2-105, at the circumference of face 2-103, is visible. This coin-shaped design is exemplary, however, and a wide variety of other shapes may be used in a soap bar implementing aspects of the present invention. For example, an ordinary, rectangular or curved bar of soap may be used. The round shape does confer various advantages, however, as will be discussed in greater detail below. In some embodiments, face 2-103 may comprise contours, aiding in ergonomic handling of bar 2-101, or indicia indicating aspects of use of bar 2-101 to a user, may be included.

At the center of bar 2-101, a portal 2-107 is provided, and comprised a water channel 2-109. Water channel 2-109 comprises an inner hollow 2-111, permitting water or other fluids to pass completely through the center of bar 2-101, from one side to the other. Soap bar 2-101 is subject to erosion during use for washing, because it preferably comprises soap and other surfactants and ingredients that are water-soluble. As water passes through portal 2-107, the sides of channel 2-109, such as the examples shown as 2-113, of water channel 2-109 will tend to gradually dissolve and erode, as will the remainder of bar 2-107 during washing with water. To counter the effect of erosion, and maintain a more appropriate portal size relative to the remainder of bar 2-107, as it itself erodes during use, sides 2-113 are sloped, and hollow 2-111 becomes more narrow toward its center (proceeding from side 2-103, or the opposite side of bar 2-101). This slope of sides 2-113 is shown to be linear, but, in other embodiments, may follow other geometric patterns, such as, but not limited to, progressive, exponential, parabolic, hyperbolic, stepped or other intervals of slope and slope change toward the center of hollow 2-111 and bar 2-101. In the example provided in the figure, four sloped sides 2-113 are pictured narrowing channel 2-109 as they proceed to the center of bar 2-101 from side 2103. An additional side 2-113 (also marked 2-114) is also visible, due to the perspective of the figure. Side 2-114 is one of the four sides 2-113 proceeding from the opposite side of bar 2-101 (not pictured). Although not pictured, it should be understood that an additional 3 sides 2-113 (in addition to side 2-114), which are mirror image structures of sides 2-113 proceeding from face 2-103 are also present, narrowing as they proceed inward toward the center of channel 2-109 from the opposite side. Thus, a total of 8 sides 2-113, each narrowing channel 2-109 progresses inward, are present. However, this number of sides and portals is exemplary only. In some embodiments, fewer or more sides of channel 2-109, within more portals or notches, which may themselves be more complex shapes, may be used. For example, in another embodiment, discussed below, additional portals, which are round, and channels with curved insides are provided.

To aid in preventing excessive erosion of portal 2-109, maintain its shape, and to increase scrubbing, a raised edge 2-115 is also provided at the entrance of the portal—with a surface further away from the center of the bar than face 2-103 abutting it. An additional edge or lip 2-117, is provided at the edge of bar 2-101, which also aids in scrubbing. Sloped sides 2-113 and their edges (such as, where the slopes meet one another) also aid in agitating water passing through hollow 2-111, and mixing it with surrounding air, increasing sudsing. Due to sloped sides 2-113, as bar 2-101 is used for cleansing with water and erodes inward, the entrance of portal 2-109 will progressively narrow. This narrowing of portal 2-109's entrance, on both sides of bar 2-101, counters the loss in overall bar size, maintaining a similar outer portal diameter to bar diameter ratio throughout use. This narrowing also delays the break-up of bar 2-109, at the end of use of the bar (i.e., soap sliver stage, where the bar is nearing full use and erosion).

FIG. 2.2 is a side view of the same exemplary round soap bar 2-101 set forth in FIG. 2.1. From this perspective, side 2-103 is still visible, and the its round shape, and the round shape of soap bar 2-101 generally, can be seen more clearly. In addition, the generally square shape of portal 2-107, at the entrance of channel 2-109, can be seen. Some of sloped sides 2-113 are still visible, and their congruent structures can be more clearly seen. However, in this perspective, side 2-114, on the other side of bar 2-101 and channel 2-109, is no longer visible—its view being blocked entirely by sides 2-113 on the same side of bar 2-101 as face 2-103. This blocking is due to the sloped nature of sides 2-113, narrowing to an edge (or in some embodiments, an area) at the center of bar 2-101 and channel 2-109.

FIG. 2.3 is a perspective view of an exemplary soap bar 2-301 held in a human hand 2-303 and implementing ergonomic optimization aspects of the present invention. As shown in the figure, soap bar 2-301 is preferably generally bar shaped with wide upper surface 2-305 and lower surface 2-307 (primary cleaning and handling surfaces) and with curved sides 2-309. Soap bar 2-301 is pictured being held in a preferred handling position, in which it is ideally situated for comfort and use in cleaning by a human user. In a preferred cleaning method using bar 2-301, bar 2-301 is positioned laying primarily across one or more of the user's fingers 2-311, rather than primarily on or within the palm 2-313 of the user's hand. In this position, bar 2-301 can be better controlled and articulated by the user during scrubbing, in part because the user has finer dexterity in his or her fingers, which are more greatly involved in handling. One of curved sides 2-309—specifically, proximal side 2-315—is inwardly-curved, toward the center of soap bar 2-301, and with a geometric shape approximately conforming to the curved line of the upper pads 2-317 of the user's palm 2-313. Proximal side 2-315 may also comprise sub-curves (e.g., scalloping, dents or bevels) following the bulge of each of the user's four upper palm finger pads (not pictured). In some embodiments (not pictured), a distal side 2-317 also comprises the same or a similar curve as proximate side 2-315, giving soap bar 2-301 a bilateral symmetry lengthwise as well as along its width (pictured). In other embodiments, proximal side 2-315 is also beveled along edges in common with lower surface 2-307 (and, in some embodiments, also upper surface 2-305, making them interchangeable). That bevel, if included, may itself be curved. Generally, any of the edges pictured of soap bar 2-301 may also be curves rather than sharp edges, and continuously blended into a graduated shape with the remainder of soap bar 2-301. Preferably, outer sections 2-319 are included, which extend beyond the outer width of fingers 2-311 (preferably, even when spread). This creates a larger cleaning surface area and additional, more effective water flowing regions, in certain embodiments discussed in greater detail below.

As will also be explained in greater detail below, one or more of broader surfaces 2-305 and 2-307 may also comprise contours, edges and/or portals positioned to fit between fingers 2-311 and scalloping to accommodate fingers 2-311. These features also serve to enhance scrubbing, and may be present on both sides 2-305 and 2-307, for both left- and right-handed use. However, for simplicity, those features are omitted in the present figure and treated instead in FIG. 2.4.

FIG. 2.4 is a bottom view of another exemplary soap bar 2-401 implementing ergonomic optimization aspects of the present invention, and aspects of the invention related to internal water flow and foaming. Soap bar 2-401 generally has the same overall shape as soap bar 2-301, discussed with reference to FIG. 2.3, above. However, due to the bottom view perspective, the full faces of curved sides, now 2-409, are not visible. Depicted for the first time in the figure is an exemplary array 2-406 of exemplary portals, such as the examples shown as 2-408, in lower surface 2-307/2-407. Portals 2-408, as with portals 2-107, discussed previously, each comprise an interior hollow 2-411 that permits water to pass completely through soap bar 2-401 (from one side to the other). Also as with portals 2-107, portals 2-408 each comprise water-channeling interior sides, such as the examples shown as 2-413, serving as the boundaries of a water channel, which narrows toward the center of soap bar 2-401. Also as with portals 2-107, a protective edge, such as the examples shown as 2-415, may surround each portal 2-408.

Portals 2-408, and the water-channeling hollows 2-411 within them, are arranged within array 2-406 with sufficient distance between them to prevent soap bar 2-401 from breaking apart prior to substantially full use. In other words, when soap bar 2-401 reaches the "soap sliver" stage, being too thin for practical use as a soap bar because it can no longer be gripped at its sides, soap bar 2-401 will retain itself as one cohesive whole, if typical soap bar formulations are used. In addition, using such formulations, each portal 2-408 will retain its individuality, rather than join, with other portals 2-408. An example of such a formulation, using glycerine, is as follows: Cocos nucifera (saponified coconut oil)—23% by weight; saponified palm oil—22%; saponified safflower seed oil 17%; glycerine 15%; Purified water 10%; sorbitol 2%; sorbitan oleate 1%. However, a wide variety of common soap formulations will suffice, including the formulation used by DOVE and IVORY soap, and other common glycerine-based soaps.

Portals 2-408 are situated on lower surface 2-407 along raised ridges or bulges ("ridges"), such as the examples shown as 2-421. As a result, each portal does not appear to be completely round, although it is and is distorted by perspective in following the contours of ridges 2-421. Ridges 2-421 generally follow the natural positioning of the spaces between or abutting a user's fingers when placed naturally against lower surface 2-407, while holding it in the position indicated in FIG. 2.3, as discussed above. As a result, a user will tend to naturally place his or her fingers in the areas, such as examples 2-423, between ridges 2-421, easing the passage of water between his or her fingers, and, by the same token, easing the passage of water through portals 2-408 and hollows 2-411. An exemplary method of use of bar 2-401 is to hold its contours in the position indicated in FIG. 2.3, with ridges 2-421 spreading his or her fingers, directing or allowing water to flow onto the back of his or her hand as he or she is scrubbing a surface with it, and then allowing water to flow through hollows 2-411 onto the surface, with suds picked up by passage through hollows 2-411.

FIG. 2.5 is a bottom view of another exemplary soap bar 2-501 implementing ergonomic optimization aspects of the present invention. As with soap bars 2-301 and 2-401, bar 2-501 comprises a series of contours accommodating a human hand, when held at the fingers (as discussed with reference to FIG. 2.3) with proximate edge 2-515 facing the user's palm. These contours uniquely accommodate a variety of human hands when held in different positions and directions. In addition, the contours of bar 2-501 comprise several local lobes 2-516, representing enlarged bodies of soap material. These lobes 2-516 can be used preferentially by the user as scrubbing surfaces, while preventing the break-up of the whole bar of soap 2-501. In addition, any and all other features of soap bars set forth above may be included in soap bar 2-501, along with the ergonomic aspects set forth herein.

FIG. 2.6 is a bottom view of a unique exemplary combined soap bar, grooming and scrubbing brush 2-601, in accordance with aspects of the present invention. Soap bar brush 2-601 is preferably composed entirely of soap material, and even more preferably, a transparent glycerine-based soap material 2-603, and comprises a water-channeling pattern of roughly pyramidal scrubbing projections, such as the examples pictured as 2-605, each with a raised end, such as the example shown as 2-604 (in the direction out-of-the-page, in the positive-z axis, in the perspective of the figure) coming to a point, and a broad base section (see the example 2-606), that merges into a main body of the soap (into-the-page). In some embodiments, a central chamber of bar and brush 2-601 may be filled with a liquid soap, oil, moisturizer, cosmetic or other applicant, and each of projections 2-605 may comprise a central channel that communicates with the central chamber and opens at a port at the end and center of the points of each of projections 2-605. In some embodiments, these ports may be variably closed, with the aid of a pressure-opening valve held at the tip of distal raised end section 2-604.

In a preferred method, a user grabs bar/brush 2-601 via its ergonomic handle (grasping the side of the bar/brush facing into-the-page, in the perspective of the figure) with his or her thumb on side 2-607*a* or 2-607*b*, and one or more of his or her fingers on the other of those two sides. Retention edges 2-609 then aid in the user's maintaining grip on the bar/brush as he or she grooms and cleanses a mammalian or other hirsute animal with the side of bar/brush 2-601 comprising projections 2-605, while the curved profile of those edges increase comfort despite that retaining pressure. The user may also introduce water to the outside of bar/brush 2-601, or add water or other applicants to the central chamber of the bar/brush. To aid in doing the latter, an openable/sealable portal (not pictured) may be included that communicates with the central chamber.

FIG. 2.7 is a front view of an exemplary bubbleflow soap bar 2-701 comprising internal water flow and foaming aspects and ergonomic and storage aspects of the present invention. As with the exemplary soap bars set forth in FIGS. 2.1 et seq., soap bar 2-701 comprises water channeling techniques, but, in this instance, comprising a plurality of water channels and ports, 2-703-2-713. Port and channel 2-713 is particularly large and robustly-fortified with defining soap material. In a preferred embodiment, a user uses port 2-713 as a hook anchor, for hanging soap bar 2-701 on shower caddy, faucet handle, or any other suitable projection in a bathing area, obviating the need for a soap dish, and reducing soap saturation and soap scum. A user also preferably uses the many curved edges resulting from neighboring portals and channels as scrubbing surface features. In another method of use, a user may dunk any of channels and ports 2-703-2-713 in a body of soapy water, or otherwise connect a soap film across and covering any of those channels and ports. A user may then blow bubbles by exhaling through the port(s) so covered with a soap film. Each of the portals also enhances the gripability of bar 2-701, as a users fingers readily penetrate and wrap around any of the channels and ports, in addition to the overall body of the soap bar.

3. Cornerfill Pillow

Abstract/Summary

A specialized pillow and pillowcase with an outer surface conforming to the interior corner of a common couch with right-angle (or rounded right-angle) corners, and an inner (user-facing) surface with rounded profile and an enlarged lower support volume, following the inverse of the V-shaped contour of a user's torso (without regard to his or her arms). In some embodiments, an anchor fitted to the underside of a couch cushion is also included.

FIG. 3.1 is a side view perspective drawing depicting an exemplary corner-filling and body-conformed pillow 3-101, in accordance with aspects of the present invention. Generally, pillow 3-101 is composed of flexible, relatively compliant materials, preferably with a central stuffing inside of an outer fabric surface, stitched together at seams. However, any known mode of constructing pillows suitable and other furniture pieces for human or other animal use may, alternatively or in addition, be used, while implementing aspects of the present invention.

In the side view perspective depicted, a far left vertical edge 3-103 is provided. Vertical edge 3-103 is substantially vertical and straight in orientation, although it may be slightly curved, and more so with use over time, due to the compliant nature of the materials used and the interplay of tension between the surrounding fabric shell 3-100 of pillow 3-101, and its interior components (discussed further below). An optional internal structural piece 3-104, which is preferably also flexible, with bendable but resilient (i.e., a leaf spring), but semi-rigid (e.g., made of a flat plastic panel), and with rounded edges to prevent piercing the outer fabric panels of pillow 3-101 and to prevent user injury, may be included. In some embodiments, internal structural piece 3-104 is attached to the inside of back fabric panel 3-105, to maintain the approximately vertical and straight nature of edge 3-103 and the shape of panel 3-105. Internal structural piece 3-104 may also support angles, edges and orientations of other fabric panels, pillow stuffing, and other elements of pillow 3-101, including edges 3-107 and 3-109 and the bottom of the pillow (not pictured in the present figure), as will be discussed in greater detail below.

Edge 3-103 forms a joint with edge 3-107 at a corner insertion point 3-111. In a preferred method, a user inserts point 3-111 into the corner of the approximately rectangular seating area of a couch or sofa. To best compliment the partial rectangular box shapes of many such couch seating areas, the angle between edge 3-107 and edge 3-109 (at point 3-111) approximately 90 degrees. The angle only appears to be more oblique in the present figure due to the perspective of the side view, in which edge 3-105 is further away from the viewer than edge 3-109. Because panel 3-105 is attached to edge 3-109 at the right-hand side of the figure, edge 3-107 of panel 3-105 is closer to the viewer as well, progressing from the left-hand side of the figure toward the right-hand side. The bottom of pillow 3-101 is also flat and perpendicular to edge 3-103, appearing otherwise only when not accounting for the perspective of the figure.

A front panel 3-113 is attached to side panel 3-105 at seam and edge 3-109. Front panel 3-113 increases in girth as one progresses downward vertically, in the perspective of the figure. Internal stuffing also increases downward, progressively, and panel 3-105 also increases in lateral width as one progresses downward, to accommodate that increased girth while maintaining a sealed outer surface of fabric for pillow 3-101. The amount and nature of the increase in volume, progressing downward, and the shape of pillow 3-101 generally, is chosen to fill a void created by a user's back, that user's back faces directly into the corner of the rectangular box-shaped couch seating area in which insertion point 3-11 is inserted, as discussed above. Thus, in the preferred method, where a user first installs pillow 3-101 into the corner of a rectangular box-shaped seating area of a sofa, he or she may then further secure pillow 3-101 in its position, and a user may seat him or herself in the seating area with his or her back reclined and facing directly into the corner of the couch seating area, and also with his or her back pressed against front panel 3-113. Structural piece 3-104 preferably is not directly attached to front panel 3-113, to increase user comfort. Although shaped to fit into the wedge-shaped void created between a user's back and the corner of the seating area of the couch, in an alternative method, a user faces directly forward in the seating area, abutting the corner of the couch, and the shape serves to fill the wedge-shaped void between his or her side-torso and the corner of the couch. In either method, once so installed and in use, pillow 3-101 serves to aid in supporting a user's back or torso when seated in rectangular box-shaped seating areas, increasing comfort and decreasing fatigue over time.

FIG. 3.2 is a top view perspective drawing depicting the same exemplary corner-filling, body conformed pillow 3-101, and an exemplary couch 3-201 with an exemplary rectangular box-shaped seating area 3-200, in which pillow 3-101 is installed. As discussed above, a method for installing pillow 3-101 into a partial rectangular box-shaped seating area, such as 3-200, includes inserting pillow corner 3-111 (and edge 3-103, of which corner 3-111 is a part) into a corner 3-203 of that partial rectangular box-shaped seating area. Thus, in the present figure, pillow 3-101 is shown so installed, with edge 3-103 inserted firmly into the corner 3-203 of seating area 3-200, substantially occupying it.

In this perspective, it can be seen that edge 3-107 of pillow 3-201 is substantially perpendicular not only with edge 3-103, but also with a mirror-image edge 3-108 of pillow 3-201, opposing it. As installed, edges 3-107 and 3-108 each are pressed against, and immediately abut walls 3-207 and 3-208 of the partial rectangular box-shaped seating area 3-200. The bottom of pillow 3-101 is pressed against a cushion 3-205 or other flat surface of couch 3-201 in the installed position, at the lower, seat area of the partial box-shaped seating area 3-200. The bottom and edges 3-107 and 3-108 are each held in the position pictured, after insertion into corner 3-203, by gravity and/or by a user's back or flank, if pressed up against it. In other embodiments, however, additional fixation techniques are provided. For example, in FIG. 3.3, discussed in more detail below, an embodiment of corner-filling, body conforming pillow with an anchor is provided that tucks into cushion 3-205. A wide variety of optional fixation aspects may, in addition or alternatively, be used to maintain a desired installation position for pillow 3-201. As another example, in some embodiments, Velcro, snaps, buttons or any other known connectors may line or be included on pillow 3-201 and seating area 3-200, where pillow 3-201 and area 3-200 abut one another in the installed position.

FIG. 3.3 is a side/rear perspective view depicting another exemplary corner-filling and body-conformed pillow 3-301, in use by a human user 3-303 on couch 3-201—itself shown in a rear cross-sectional view along plane 3-A, shown in FIG. 3.2. Pillow 3-301 comprises every element of pillow 3-101, some of which are numbered accordingly. However, in addition, pillow 3-301 comprises installation anchoring aspects, which will be discussed in further detail below.

Pillow 3-301 is pictured in the same installed position as depicted for pillow 3-101, as discussed in FIG. 3.2, above. From the rear view of couch 3-201 and pillow 3-301 installed in the corner of seating area 3-200, fabric panel 3-105, and its edges 3-103, 3-107 and 3-109 are each visible, with panel 3-105 facing and substantially perpendicular to the viewer.

The human user 3-303 is in an unusual seating position, with her back 3-305 facing directly into corner 3-203, and leaning into panel 3-113 (not visible in the figure). Her left arm 3-307 is resting on arm 3-309 of couch 3-201, while her right arm is resting on the back of the couch (not pictured in this cross-sectional view). Thus, the user 3-303 is substantially reclined (leaning back), resting her arms on the couch. In this position, as can be seen in the figure, pillow 3-301 substantially fills the negative space 3-305 created between user 3-303's back and seating area 3-200. Pillow 3-301 substantially fills negative space 3-305 due to its inherent shape. In addition, pillow 3-301, due to its compliant nature, yields to and conforms with the user's particular body shape, pressed against it, as shown by dashed yielding conformation line 3-309. In so doing, pillow 3-301 does not break down or buckle, due to its resilience, and, by virtue of its elasticity, creates supporting and cradling forces on the user's body.

To aid in maintaining its installed position, an insertable anchor 3-330 is provided. Anchor 3-330 is attached to, and retains the corner-installed position of, pillow 3-301 with the aid of adjustable strap 3-331, which is attached both to anchor 3-330 and pillow 3-301. Adjustable strap 3-331 may be adjusted in length by virtue of a clamp, buckle, ratchet, or any other known method for selectively shortening or lengthening supporting straps. An exemplary length-adjusting buckle is set forth as length adjuster 3-333. In a preferred method of use, prior to seating, anchor 3-330 is inserted underneath cushion 3-205, and between the bottom of cushion 3-205 and the base 3-335 of seating area 3-200. To further aid in maintaining anchor 3-330's position, surface barbs 3-337 may be included. In other embodiments, a friction enhancer (such as tape, Velcro or other grabbing or sticking materials) or fastener (such as any of the other surface fasteners discussed elsewhere in this application) may be included on the surface of anchor 3-303, and/or surfaces of seating area 3-200 or cushion 3-205, to establish a connection between them and anchor 3-330. In some embodiments, strap 331 is elastic, or attached to a spring (as pictured) to aid in maintaining anchoring tension.

When human user 3-303 assumes a normally seated position within seating area 3-200 edge 3-109 substantially fits the negative space created by user 3-303's torso when so seated, due to its inherent shape. Similarly to FIG. 3.3, pillow 3-301 also substantially yields to and conforms with the user's particular body shape when in the normally seated position, pressed against pillow 3-301. In so doing, pillow 3-301 again does not break down or buckle, due to its resilience, and, by virtue of its elasticity, creates supporting and cradling forces on the user's body. In fact, pillow 3-301 experiences less force, and needs generate less supporting force, to support user 3-303 in the seated position (when compared to the position set forth in FIG. 3.3, above.

FIG. 4 is a side view of an exemplary couch 400 with modular, standardized raisable user-support sections 401, in accordance with aspects of the present invention. In the example provided, at least two such raisable sections, 403 and 405, are provided. However, it should be understood that any number of a plurality of such modular sections may be used to carry out aspects of the present invention. In addition, a number of fixed user support sections, such as the examples pictured as 407, 409 and 411, may also be included. Raisable support sections 403 and 405 are attached to, and may be raised by, support pipes, such as the examples pictured as 413 and 415, to rest at any number of heights, and certain particular heights, at the election of a user. Support pipes 413 and 415 are slidingly engaged with pipe-holding channels or grooves 417 and 419, respectively, and may, in some embodiments, comprise physical stops (e.g., pin holes and cotter pins that rest against the housing of channels or grooves 417 and 419). However, in a preferred embodiment, channels or grooves 417 and 419 comprise individually-controlled linear actuators, which may raise pipe 413 and 415, and, therefore support sections 403 and 405, to a wide variety of different heights selected by a user and or a control system comprising those linear actuators. An example of such a control system is provided below, in reference to FIG. 6.5, below.

Certain raised heights of support sections 403 and 405 are pictured, and may be dialed in by the user or a control system to provide particular, unique surface emulations by periodic placement of the support sections. For example, the raised positions 421 and 423 create an emulation of a slightly-inclined yet strictly contoured chair back. As another example, positions 425 and 427 create an emulation of a flat, raised side table, with strict rectilinear contours. Finally, a user or the system may also select a "flat" configuration, in which both support sections 403 and 405 are set at a level equal to, and indistinguishable from, fixed sections 407-411 (a "flat" configuration). In a preferred embodiment a user may adjust levels of certain sections with gestures felt by sensors within the support sections. For example, the control system may sense when a user presses on and off the top of a section in a small, isolated area on which he or she is not resting other pressure (or, in some embodiments, stroking the side of the support structure), and begin to lower until the pressure ceases. As another example, pressing in such a way twice, rapidly, may cause a section to raise until the second press ceases. However, control over raising and lowering actuators may be by any suitable means, including standard GUIs (e.g., button array, remote control or networked smart device).

Figure 5:
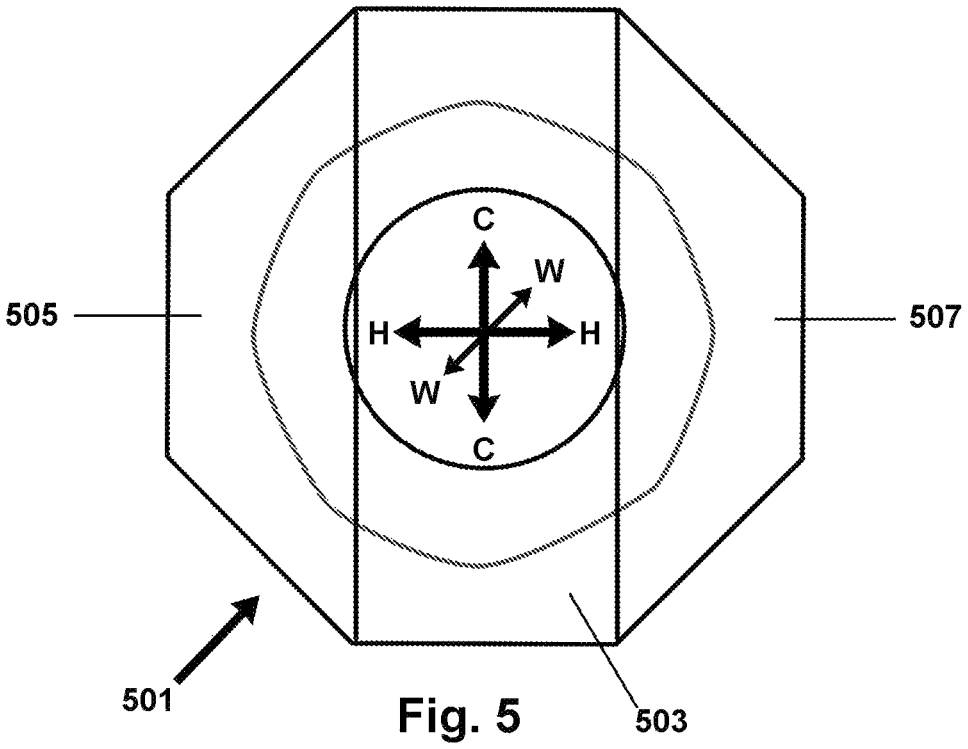
FIG. 5 is a top view of an exemplary sporting surface coating wax bar, in accordance with aspects of the present invention.

FIG. 5 is a top view of an exemplary sporting surface coating wax bar 501, in accordance with aspects of the present invention. A user may use wax bar 501 to coat a number of board and other sporting equipment surfaces, including, but not limited to surf boards. In addition to compositions of high-grip, spreadable wax known in the art, wax bar 501 comprises a number of unique advantages. First, sections of bar 501 comprise different grades of wax, suitable to different environmental conditions. For example, a central section, strip 503, may comprise a tackier, softer blend of surf wax (a.k.a. a "cold water wax") than the remainder of bar 501. Cold water strip 503 is suitable for application to sporting boards in colder environments, where it remains tackier, retaining its grip at those temperatures. Side strips 505 and 507, by contrast, may comprise a harder grade of wax (a "hot water wax"), more suitable for application in hotter climates, were it resists becoming runny while retaining an adequate tack.

By orienting bar 501 as pictured, and rubbing its bottom or top edge (as indicated by usage indicator guide for cold water use (aligning the application side with arrow marked "C"), a user can apply wax to a board with a greater amount and concentration of cold water wax. By rotating bar 501 90 degrees, by contrast, an applying either of the edges indicated with the arrow maker "H," a user can apply a greater amount and concentration of hot water wax. Finally, by applying bar 503 at a 45 degree angle from that pictured, applying sides as indicated by the guide arrow marked "W," a user can more evenly blend the two types of waxes, creating a blend of waxes suitable for all-temperature or "warm water" use.

The exact orientations, shapes and amounts of different blends of wax, or other sporting equipment treatments, is exemplary only. For example, in some embodiments, the strips may be in greater numbers, and angled to create a greater spread of different application angles.

FIG. 6.1 is a perspective drawing of an exemplary unpowered programmable display device 6-101, implementing aspects of the invention related to hanging art. According to aspects of the present invention, device 6-101 may be programmed and hung on a wall, such as exemplary wall 6-103, to temporarily or permanently display a particular artistic pattern according to the wishes of any user and a wide variety of pattern source materials. A front-facing display screen 6-105 faces away from wall 6-103, on which device 6-101 is temporarily mounted. In addition to other aspects, which will be discussed in greater detail below, with respect to additional figures, display screen 6-105 comprises an array of hundreds of picture elements ("pixels"), such as the examples illustrated as pixels 6-107. Each of pixels 6-107 is approximately box-shaped, with a square front-profile, and are configured for red, green and blue color output, at the selection of a user. However, other pixel shapes and types, such as round, or sub-component pixels, or color schemes, such as black-and-white, or CMYK color output, may be used alternatively or in addition to the approach set forth in the figure.

As will be discussed in greater detail, below, each pixel 6-107 is preferably capable of passive, reflective light emission, requiring no power to output an image through display device 6-107, via specialized, individually- and externally-addressed sub-components. Nonetheless, display device 6-107 may be enhanced and altered by external power and light sources, as will also be explained.

FIG. 6.2 is an enlarged perspective drawing of aspects of part of the same exemplary display device discussed in reference to FIG. 6.1, along with a temporarily-conjoined pixel-setting device 6-202. A section, 6-201, of the display device comprises a subset of the same pixels of the display device, some of which are now shown as 6-203, as discussed in reference to FIG. 6.1, above. As mentioned above, in some embodiments, each such pixel 6-203 comprises several subcomponents, which will be discussed in greater detail with respect to one exemplary pixel 6-205. However, it should be understood that each pixel may contain one or a plurality of the sub-components such as those to be discussed in reference to pixel 6-205, and that the omission of each such subcomponent in the illustration is for the purposes of clarity and simplicity of illustration only. It should also be understood that, in some embodiments, a single insertable/ejectable pixel component is held within the grid 6-207 of pixels 6-203. In such embodiments, each pixel is simultaneously ejected and replaced by a replacement pixel injected in its place by pixel-setting device 6-202 when it addresses the display device, as will be explained further below, with reference to FIG. 6.6.

However, in the presently-illustrated embodiment, each pixel remains within section 6-201 of the display device, and is externally addressed and altered by pixel-setting device 6-202 to create a pattern selected by a control system controlling or comprising setting device 6-202, and/or by a user. An example of such a control system is provided, below, in reference to FIG. 6.5.

First, exemplary pixel 6-205 comprises a multi-colored (and/or multi-shaded and/or multi-transparency), rotatable spherical display sub-element 6-209. Display sub-element 6-209 is held within pixel 6-205 in a fixed orientation due to friction and the normal forces of walls 6-211, comprised in pixel 6-205. But spherical display sub-element 6-209 may be addressed and rotated, and indicates its rotational position, in multiple directions within pixel 6-205, due to a magnetic or electrostatic dipole—illustrated by a positively-charged region 6-213 and a negatively-charged region 6-215. In some embodiments, at least three separate, local charged regions such as 6-213 and 6-215 are comprised in spherical display element 6-209, such that different gradations in color, shading and transparency within and/or on the outer surface of element 6-209, and collocated with the charged regions, can be both detected and dialed in by the control system. In one embodiment, each such detectable/addressable charged region is associated with a distinctly-colored or shaded outer surface region spherical display sub-element 6-209. These regions can overlap, such that, drawing two charged regions, one associated with changing color gradient (e.g. green, transitioning to red) and another associated with a shading gradient (e.g., light to dark) can result in sub-element 6-209 displaying a darker shade of red (or vice versa). In other embodiments, multiple types of such display sub-elements may be held in the same, or neighboring pixels, each with regions dedicated to displaying one such system-changeable gradient.

In turn, pixel-setting device 6-202 comprises at least one pixel-addressing and-setting element ("setting element") 6-217, capable of detecting and generating differing local magnetic fields. In some simpler embodiments, setting element(s) may be comprised in a moving head, and thereby serially address multiple pixels of the display device, being serially repositioned near each of a succession of pixels, reading their current output data, assessing necessary changes for a new display output, and generating magnetic or electrostatic fields necessary to cause those rotational changes. A method incorporating such an approach is discussed further in reference to FIG. 6.4, below. However, a one-to-one ratio or other fixed ratio of setting elements and display pixels may also be used. In one embodiment, setting element 6-217 may simultaneously generate multiple magnetic fields, with differing effects in several regions, differently-actuating different sub-elements of each pixel 6-205.

For example, another, shifting sub-component 6-219 of pixel 6-205 and spherical sub-component 6-209, may also comprise its own dipole within a control-system-alterable cylindrical display sub-element 6-220. Shifting sub-component 6-219, also includes positively and negatively-charged cylindrical regions, 6-221 and 6-223, respectively, which also may be addressed, read and controlled by a control system comprising pixel setting device 6-202. These aspects may be better viewed and understood in the enlarged illustration provided in FIG. 6.3.

By altering magnetic fields and/or electrostatic fields within pixel-setting device 6-202, such a control system and the pixel setting device 6-202 may both, and separately, control the rotation of spherical display sub-element 6-209, and the degree of shifting of sub-component 6-219 within at least partly transparent sleeve 6-225, altering the appearance of at least part of spherical display sub-element 6-209, in which it is embedded. For example, in one embodiment, the front edge (facing generally out of the page, in the perspective of the figure) of sleeve 6-225 is composed of a transparent, green material, while the front edge (also facing generally out of the page) of shifting sub-component 6-219 is composed of a red material, each of which materials permits the transmission of light through them. The control system may cause sub-component 6-219 to shift toward the front of the display within sleeve 6-225 and, as a result, display sub-element 6-220 will begin to show a blend of both red and green colors, whereas prior to that shifting, or if the control system causes sub-component 6-219 to reverse-shift, into the display, sub-element 6-220 will show a greater amount of green color to a person viewing the display section 6-201. Similarly, if both sub-component 6-219 and sleeve 6-225 contain light-blocking components at certain points, which the system similarly causes to be drawn together, light transmission can be reduced, and the appearance of shading can be created by the display. Of course, the illustration of just one such sleeve 6-225 and sub-component 6-219, and just one display sub-element, as with the inclusion of just one spherical display sub-element 6-209 comprising it, within FIGS. 6.2 and 6.3 is purely for simplicity and clarity of illustration, and it should be understood that a display device implementing aspects of the present invention may have many, such as millions of such sub-components and sub-elements, within each pixel and spherical sub-element, and within the display as a whole.

To control both the rotation of spherical display sub-element 6-209 and the shifting of sub-component 6-219, discussed above, pixel-setting device 6-202 (and/or, a reading and writing head comprised within device 6-202) may have multiple regions that abut at least one pixel during a procedure setting the appearance of the display. For example, a central, rotation-controlling and locking region 6-227 is most proximate to spherical display sub-element 6-209 during a reading/writing operation and, by altering its charge or dipole, the control system may draw positively- or negatively charged regions 6-213 and 6-215 closer to it, causing the opposing side (and color or shading) to be displayed. As sub-element is held in such a position, a second region of the read-write device 6-202, 6-229, more proximate to shifting sub-component 6-219, may still cause subcomponent 6-219 to shift within sleeve 6-225, as dictated by the control system connected with it, and altering the magnetic or electrostatic charge of region 6-229. Additional separately-controlled regions of pixel-setting device 6-202 (or of an individual head or heads thereof), abutting other such subcomponents, may likewise be altered by a connected control system to separately alter those other subcomponents, creating a wide variety of shading, color and other display characteristics at the sub-pixel level. Preferably, the rotation of spherical sub-element 6-209 is not affected by the actuation of sub-component 6-219 because the amount of magnetic field used to actuate sub-component 6-219 is below the amount necessary to overcome friction or a binding force from the read-write head holding spherical sub-element 6-209 in a fixed rotational position (e.g., normal forced from walls 6-211).

If a fixed array of read/write heads within read/write device 6-202 is used, as shown by exemplary head outlines 6-230, each such head may abut a separately-addressed pixel, increasing the speed with which the display's appearance may be set, and reducing the number of moving parts. In other words, in that embodiment, a user simply removes the display from a position where it was installed, slides pixel-setting device 6-202 over it, and initiates the pixel-setting routine which is then carried out on each pixel of the display simultaneously, according to image and pixel data selected by the control system including the setting device. However, in other embodiments, having other advantages, a moving read/write head comprised within setting device 6-202 may instead, or in addition, be used.

FIG. 6.4 is a process flow diagram, illustrating exemplary steps 6-400, that may be carried out by a control system (such as the control system set forth in FIG. 6.5, below) implementing aspects of the present invention related to displaying images using a display device (such as the display devices discussed above). Beginning with step 6-401, the control system first selects image data for an image to be displayed, and sets an initial action plan for altering pixels of the display device to display the image to be displayed. As noted in step 6-401, the action plan selected is preferably optimized for efficiency, which optimization may involve comparing a wide variety of possible starting pixels and rows, and pathways following from them, to be altered by a pixel-setting device. As discussed elsewhere in this application, some pixel alterations may be carried out by remote adjustments to each pixel to be altered, as by remotely applied magnetic and electrostatic fields. However, other pixel alterations may be carried out by replacing pixels, for example by inserting new pixel units and ejecting prior pixel units held in a display (see FIG. 6.6). Accordingly, in the exemplary process 6-400, the control system may first determine whether either type of pixel alteration is required to be conducted with respect to each pixel, to render the image to be displayed, in step 6-403. If, with respect to the first pixel being altered by the control system to render the image, a pixel replacement operation is required to render the needed change, the system proceeds to step

6-405. If not, the control system proceeds to step 6-420, as will be discussed in greater detail below. In step 6-405, the control system may directs a pixel replacement head to position itself to insert a particular type of pixel (e.g., of a particular color, shading or transparency selected by the system) into a pixel-holding port, as discussed in FIG. 6.6, below. The system may load the data necessary for the pixel to be inserted, and queues up a pixel of the proper type into a read/write head for insertion into the port, in steps 6-407 and 6-409. In addition, in step 6-411, the pixel may then be altered to better match the characteristics required to render the image to be displayed, using any of the methods and devices discussed in this application for altering the appearance of pixels. The system then proceeds to inject the new pixel in step 6-413, and thereby eject and, optionally, capture a pixel previously occupying the port, as set forth in greater detail below in FIG. 6.6. The system may also read data from the injected pixel placed in the port at each position to confirm that the final appearance of the pixel is the proper appearance required to render the image to be displayed, in optional step 6-415. If the appearance does not match the required display output, the control system may return to step 6-403 or 6-407, replacing or altering the pixel at that position again. If a second pass still fails to yield such a confirmation, the system preferably reports an error or flaw at the related port position and/or resumes the process with respect to other pixels and/or paths. In some embodiments including selective lighting in displays, the control system may also transfer data related to lighting each respective pixel to the display, where it may dictate the type and degree of lighting to be added to a particular pixel or pixel position. The system then returns to the starting position.

As mentioned above, if, at step 6-403, the control system determined that pixel replacement was not required at the particular pixel position, the control system proceeds to step 6-420, in which the a applied alteration to the pixel at that position, instead, is initiated. The system loads pixel data in step 6-421 for the first pixel to be altered in the selected action plan, and, in step 6-423, may position a floating read/write pixel alteration head over the pixel (if necessary in the particular embodiment for read/write operations). The system may also read/sense the existing data represented or otherwise currently held in the pixel at that position in step 6-425. The system may then assess the changes required for that pixel, to create the appearance of the pixel required to render the image to be displayed, for example, using any of the other pixel alteration devices and methods set forth in this application. The system then may load that pixel alteration data for implementation, for example, in a short-term, immediate data storage device (e.g., RAM within a read/write head) in step 6-427. In step 6-429, the system affectuates the required changes at the selected pixel/position, for example, by activating magnetic or electrostatic fields to move pixel sub-elements and components, as discussed in FIGS. 6.2 and 6.3, above. Finally, as in steps 6-415 and 6-417, the system may take measures to confirm and adjust resulting pixel display attributes and transfer lighting data to the display, in steps 6-431 and 6-433 before returning to the starting position.

FIG. 6.5 is a schematic block diagram of some elements of an exemplary control system 6-500 that may be used in accordance with aspects of the present invention, such as, but not limited to, communicating with, controlling and actuating: sensors and diffusion devices, pixel alteration and replacement hardware for displaying images, sensors, pumps, motors, and other system functions set forth in this application. Exemplary control system 6-500 also may be used for receiving, and taking actions based on sensed statuses, programming, user commands or other behavior, such as a user selecting a new image for display on a display device, and coupling a display device with a pixel alteration device, as discussed in reference to FIGS. 6.1 through 6.6. The generic and other components and aspects described herein are not exhaustive of the many different systems and variations, including a number of possible hardware aspects and machine-readable media that might be used, in accordance with the present invention. Rather, the system 6-500 is described to make clear how aspects may be implemented. Among other components, the system 6-500 includes an input/output device 6-501, a memory device 6-503, storage media and/or hard disk recorder and/or cloud storage port or connection device 6-505, and a processor or processors 6-507. The processor(s) 6-507 is (are) capable of receiving, interpreting, processing and manipulating signals and executing instructions for further processing and for output, pre-output or storage in and outside of the system. The processor(s) 6-507 may be general or multipurpose, single- or multi-threaded, and may have a single core or several processor cores, including, but not limited to, microprocessors. Among other things, the processor(s) 6-507 is/are capable of processing signals and instructions for the input/output device 6-501, analog receiver/storage/converter device 6-519, analog in/out device 6-521, and/or analog/digital or other combination apparatus 6-523 to create a functional display, light-affecting apparatus and/or other user interface with active physical controls, such as an infuser mixing control or a specialized GUI for selecting and creating new images for display on a display device by coupling with a pixel alteration device, and to provide it for use by a user on hardware, such as a personal computer monitor or PDA (Personal Digital Assistant) screen (including, but not limited to, monitors or touch- and gesture-actuable displays) or terminal monitor with a mouse and keyboard or other input hardware and presentation and input software (as in a software application GUI), and/or other physical controls. Alternatively, or in addition, the system, using processors 6-507 and input/output devices 6-519, 6-521 and/or 6-523, may accept and exert passive and other physical (e.g., tactile) user and environmental input and output.

For example, and in connection with aspects of the invention discussed in reference to the remaining figures, the system may carry out any aspects of the present invention as necessary with associated hardware and using specialized software, including, but not limited to, controlling the replacement, alteration and lighting of pixels on specialized displays to create new images for long-term display, and control the actuation and sensors in devices used in drinking vessels, or actuators altering the level of standard user support units in furniture. The system may also, among many other things described for control systems in this application, respond to user, sensor and other input (for example, by a user-actuated GUI controlled by computer hardware and software or by another physical control) to activate/deactivate specialized mixing, refrigeration and infusing systems, select images for replacement or long-term display, or select patterns for furniture surfaces. The system 6-501 may also permit the user and/or system-variation of settings for any of those aspects, including but not limited to the affects of user activity on modes of operation of the system, and send external alerts and other communications (for example, to users and administrators via a larger external network, including but not limited to external servers on the Internet) via external communication devices, for any control system aspect that may require or benefit from such external or system-extending communications.

The processor 6-507 is capable of processing instructions stored in memory devices 6-503 and/or 6-505 (and/or ROM or RAM), and may communicate with any of these, and/or any other connected component, via system buses 6-575. Input/output device 6-501 is capable of input/output operations for the system, and may include/communicate with any number of input and/or output hardware, such as a computer mouse, keyboard, entry pad, actuable display, networked or connected second computer, other GUI aspects, camera(s) or scanner(s), sensor(s), sensor/motor(s), range-finders, GPS systems, receiever(s), transmitter(s), transceiver(s), transflecting transceivers ("transflecters"), antennas, electromagnetic actuator(s), mixing board, reel-to-reel tape recorder, external hard disk recorder (solid state or rotary), additional hardware controls (such as, but not limited to, buttons and switches, and actuators, current or potential applying contacts and other transfer elements, light sources, speakers, additional video and/or sound editing system or gear, filters, computer display screen or touch screen). It is to be understood that the input and output of the system may be in any useable form, including, but not limited to, signals, data, commands/instructions and output for presentation and manipulation by a user in a GUI. Such a GUI hardware unit and other input/output devices could implement a user interface created by machine-readable means, such as software, permitting the user to carry out any of the user settings, commands and input/output discussed above, and elsewhere in this application.

6-501, 6-503, 6-505, 6-507, 6-519, 6-521 and 6-523 are connected and able to communicate communications, transmissions and instructions via system busses 6-575. Storage media and/or hard disk recorder and/or cloud storage port or connection device 6-505 is capable of providing mass storage for the system, and may be a computer-readable medium, may be a connected mass storage device (e.g., flash drive or other drive connected to a U.S.B. port or Wi-Fi) may use back-end (with or without middle-ware) or cloud storage over a network (e.g., the Internet) as either a memory backup for an internal mass storage device or as a primary memory storage means, or may simply be an internal mass storage device, such as a computer hard drive or optical drive.

Generally speaking, the system may be implemented as a client/server arrangement, where features of the invention are performed on a remote server, networked to the client and made a client and server by software on both the client computer and server computer. Input and output devices may deliver their input and receive output by any known means of communicating and/or transmitting communications, signals, commands and/or data input/output, including, but not limited to, input through the devices illustrated in examples shown as 6-517, such as 6-509, 6-511, 6-513, 6-515, and 6-577 and any other devices, hardware or other input/output generating and receiving aspects. Any phenomenon that may be sensed may be managed, manipulated and distributed and may be taken or converted as input or output through any sensor or carrier known in the art. In addition, directly carried elements (for example a light stream taken by fiber optics from a view of a scene) may be directly managed, manipulated and distributed in whole or in part to enhance output. It is to be understood that the system may use any form of electromagnetism, compression wave, particles transmissions, heat or other transmission phenomena that may be sensed, and may include directional and 3D locational information, which may also be made possible by multiple locations of sensing, preferably, in a similar, if not identical, time frame. The system may condition, select all or part of, alter and/or generate composite data from all or part of such direct or analog image or other sensory transmissions, including physical samples (such as DNA, fingerprints, iris, and other biometric samples or scans) and may combine them with other forms of data, such as image files, dossiers or metadata, if such direct or data encoded sources are used.

While the illustrated system example 6-500 may be helpful to understand the implementation of aspects of the invention, it is understood that any form of computer system may be used to implement many control system and other aspects of the invention—for example, a simpler computer system containing just a processor (datapath and control) for executing instructions from a memory or transmission source. The aspects or features set forth may be implemented with, and in any combination of, digital electronic circuitry, hardware, software, firmware, or in analog or direct (such as electromagnetic wave-based, physical wave-based or analog electronic, magnetic or direct transmission, without translation and the attendant degradation, of the medium) systems or circuitry or associational storage and transmission, any of which may be aided with enhancing media from external hardware and software, optionally, by wired or wireless networked connection, such as by LAN, WAN or the many connections forming the internet or local networks. The system can be embodied in a tangibly-stored computer program, as by a machine-readable medium and propagated signal, for execution by a programmable processor. The method steps of the embodiments of the present invention also may be performed by such a programmable processor, executing a program of instructions, operating on input and output, and generating output. A computer program includes instructions for a computer to carry out a particular activity to bring about a particular result, and may be written in any programming language, including compiled and uncompiled, interpreted languages, assembly languages and machine language, and can be deployed in any form, including a complete program, module, component, subroutine, or other suitable routine for a computer program.

In FIG. 6.6, another form of pixel setting device 6-600, serially addressing, reading and writing viewable display pixels according to aspects of the present invention, is partially illustrated in an enlarged view. As discussed above, a user may use a pixel setting device, such as 6-600, to serially and/or simultaneously alter and/or replace pixels on a display device, such as exemplary display 6-601, and select and display a new long-term decorative image (for example, on the inside walls of a building). Although the pixel-setting device 6-600 illustrates will a pixel replacement technique, it should be understood that it may also incorporate any device or technique for altering pixels remotely or otherwise, as discussed elsewhere in this application.

To use pixel setting device 6-600 to display a new image on display device 6-6-601, a user first selects an image to be displayed from an image library comprised in, or accessible to, a control system comprising the pixel-setting device. The image library may comprise any number of images at a wide variety of pixel resolutions and types, and the control system may translate, as nearly as possible, any such image, if necessary, into a representative image in a rendering format corresponding with the display output of the display device 6-601. More specifically, the rendering format will contain data corresponding to both the number of pixels (in each direction of the particular display device, which may include three or more dimensions) of the display device, and the alteration capabilities of subcomponents of the display devices pixels, as well as the representative condition required for each pixel and pixel sub-component, as discussed above. In some embodiments, lighting information for each pixel and pixel subcomponent, or a lighting device within or affecting the display device, may also be included in the image file. That lighting data may be conditional, based on environmental lighting, viewing angles and other environmental factors that may affect, and be perceived by the display device (e.g., using on-board sensors and a separate control system). In a preferred Once an image to be displayed has been selected from the library, which may be augmented by image data from an external network (e.g., free- or algorithmically rights-managed images available on services over the Internet), the user then may unmount the display device from a position where it is installed (e.g., on an interior wall of a building) and then couples the display device with the pixel setting device by placing the display device within a seating frame 6-605 of the pixel setting device 6-600. Seating frame 6-605 may provide a structural hold on the display device during coupling and pixel setting operations, which will be discussed further below, but also provides the control system comprising the pixel setting device (examples of which are covered in reference to FIG. 6.5, above) with a physical reference for addressing pixels within the display device, which are present at standardized locations from the edges of frame 6-605 incorporated in the control system's programming as well as in the physical dimensions of various components within the pixel setting device 6-600. For example, an exemplary multiple pixel source pixel insertion rail 6-607 is provided, which delivers new pixels of standard dimensions at such standardized locations according to parameters provided by the control system during pixel setting operations, as will be discussed in greater detail below. With respect to each of the display devices and pixel setting devices discussed in this application, the coupling of the two and a reliable physical reference can be encouraged by the engagement of complementary physical structures at a keying position, such as pixel setting device pin 6-604, which fits into complementary display mortise 6-606.

Pixel insertion rail 6-607 may, as illustrated, have mobile capabilities, and serially address each pixel of the display device, examples of which pixels are shown as 6-609, and insert a new, replacement pixel, as shown by exemplary injected replacement pixel 6-611, which simultaneously ejects a prior pixel, as shown by partially ejected pixel 6-613, and does so at each of several pixel locations within a pixel grid 6-615 comprised in display device 6-601. To move to each such pixel location, robotic arms 6-616 and 6-618 controlled by and in communication with the control system may be included, each arm being configured to create necessary repositioning for a particular axis (e.g., x, y or z) of rows of display pixels with comprised linear actuators 6-620 and 6-622. Linear actuator 6-622 is connected to the base of arm 6-616, allowing the control system to control the horizontal position of rail 6-607, whereas actuator 6-620 may directly control the vertical position of rail 6-607. Grid 6-615 may comprise pixel-holding separation barriers, such as the examples shown as 6-617. In some embodiments, separation barriers 6-617 comprise a transparent outer material, abutting each pixel, with lenses configured to transmit light forward when received from abutting pixels (held within the grid. In addition, barriers 6-617 may comprise an inner, reflective lens, covering the area of each barrier wall 6-617 separating each pixel from one another, and thereby segregating light in each pixel position until it exits the display 6-601. In this way, a viewer will see a brighter, more consistent and yet more defined image. Insertion rail 6-607 may move replacement pixel 6-611 out of a central holding compartment 6-619 through an open port 6-621 and into position on the grid 6-615, pushing out ejected pixel 6-613, with any suitable linear actuator (not pictured). In addition replacement pixel 6-611 may be selected from a variety of stored replacement pixels (e.g., a replacement pixel covering shades of the color blue, to represent an area of the image to be displayed requiring blue color, from a bin comprising a wide variety of pixels covering different hues and other visual effects.) To do so, the control system may advance a number of different pixels from different rows, each corresponding with a particular hue or other visual effect, and place only the required pixel, with the required hue for the target position, with a feed selector, such as the exemplary feed selector 6-623. Exemplary feed selector 6-623 may comprise a swiveling selection door 6-625, pivoted about an axel 6-627 by a servo/motor 6-629. For example, as pictured, by controlling selection door 6-625 to pivot downward (in the perspective of the figure), the control system comprising pixel setting device 6-600 can select pixels of one type of appearance, pushed upward (e.g., with a spring) through channel 6-631, while arresting the advancement of pixels of another type of appearance, in channel 6-633, or vice versa (by pivoting selection door 6-625 upward). While one form of pixel selector, with two exemplary channels and a single selection point are illustrated, for ease of comprehension, a wide variety of additional channels and sorting points and insertion rails may, in addition, be used—creating a wide variety of potential pixel replacements. In addition, as discussed above, rail 6-607 may also comprise remote pixel alteration capabilities, and pixels 6-609 may have remotely-adjustable display characteristics. Thus, as discussed in reference to FIG. 6.4, a single control system and pixel setting device 6-600 can adjust some pixels, while replacing others, according to a pathway created and selected based on an efficiency algorithm.

In some embodiments, pixel setting device 6-600 may also comprise an ejected pixel recapturing device 6-640. Pixel recapturing device 6-640 may be placed on the viewing side of display 6-601 (facing generally out-of-the-page, in the perspective of the figure) to accept pixels ejected by rail 6-607. A mobile arm 6-641 controlled by the control system may place a receiving chamber directly over the ejected pixel as it is ejected, capturing it in a capturing chamber 6-643. An internal advancer, with the aid of gravity, may then cause such recaptured ejected pixels to descend into a storage magazine 6-645, or other storage container, where it may then be re-sorted by pixel type and reused by the system in future pixel setting procedures. Recapturing device 6-640 may also comprise sensors (not pictured) that test the pixel injected into the rejected pixels place, and the control system may thereby confirm the appearance of the display at that position, and make further adjustments or replacements as necessary to render the image to be displayed, as discussed in greater detail in reference to FIG. 6.4, above.

I claim:

1. A drinking vessel comprising a cavity and at least one flexible arm(s) extending from a surface lining said cavity, said at least one flexible arm(s) having:

a first position wherein said at least one flexible arm(s) reacts with a holding force upon water and/or aqueous solution filling said cavity up to a predetermined water level, and wherein said holding force results, at least in part, from said water and/or aqueous solution being subjected to freezing temperatures and expanding, and/or becoming frozen solid at a bottom of said drinking vessel.

2. The drinking vessel of claim 1, comprising a vertical stanchion connected at, and concentric with, a bottom of said cavity.

3. The drinking vessel of claim 2, wherein said vertical stanchion comprises or is connected to said at least one flexible arm(s).

4. The drinking vessel of claim 1, wherein said at least one flexible arm(s) is connected to at least one wall defining said cavity.

5. The drinking vessel of claim 1, wherein said at least one flexible arm(s) comprises a bend or camber and at least one end(s) of said at least one flexible arm(s) is/are substantially lower than a center of said at least one flexible arm(s) when in a resting conformation, which resting conformation is one of a plurality of different physical conformations of said at least one flexible arm(s).

6. The drinking vessel of claim 5, wherein said at least one flexible arm(s) comprises at least one downward-facing tip or edge at said end(s).

7. The drinking vessel of claim 6, wherein said tip or edge rests at, about or above a water line or water line marker written in said drinking vessel.

8. The drinking vessel of claim 1, wherein said at least one flexible arm(s) is/are switchable between at least two different physical conformations.

9. The drinking vessel of claim 8, wherein a first physical conformation of said at least two different physical conformations results in said first position, and wherein said first position is an at least partially lower vertical position of said at least one flexible arm(s) than a second position resulting from a second physical conformation, and wherein said first physical conformation also results in applying a holding force to an object occupying said cavity.

10. The drinking vessel of claim 9, comprising a central tab within a base of said drinking vessel, wherein said central tab enables a user to actuate said at least one flexible arm(s) between said at least two different physical conformations.

11. A method for holding water and/or an aqueous solution below a fluid, comprising the following steps:

obtaining a drinking vessel comprising a cavity and at least one flexible arm(s), wherein said at least one flexible arm(s) extends from a surface of said drinking vessel, and is configured to grip and react with a holding force upon said water and/or an aqueous solution at least partially filling said cavity as said water and/or an aqueous solution are subjected to freezing temperature(s) and expand to become frozen solid at a bottom of said drinking vessel;

filling said cavity up to said predetermined water level, with said water and/or an aqueous solution.

12. The drinking vessel of claim 1, wherein said at least one flexible arm(s) comprise a plurality of materials.

13. The drinking vessel of claim 1, wherein said first position results, at least in part, from a material of said at least one flexible arm(s) having a high coefficient of contraction with decreasing temperatures.

14. The drinking vessel of claim 12, wherein said first position results, at least in part, from a material of said at least one flexible arm(s) having a high coefficient of contraction with decreasing temperatures.

15. The drinking vessel of claim 1, wherein said first position results, at least in part, from a material of said at least one flexible arm(s) having a low coefficient of contraction, and/or a high coefficient of expansion, with decreasing temperatures.

16. The drinking vessel of claim 12, wherein said first position results, at least in part, from a material of said at least one flexible arm(s) having a low coefficient of contraction, and/or a high coefficient of expansion, with decreasing temperatures.

17. The drinking vessel of claim 1, wherein said at least one flexible arm(s) comprise a spring.

18. The method for holding water and/or an aqueous solution of claim 11, comprising the following additional step:

subjecting said drinking vessel and said water and/or an aqueous solution to said freezing temperature(s), converting said water and/or an aqueous solution to a solid state, which then occupies greater space than before said converting into said solid state.

19. The method for holding water and/or an aqueous solution of claim 18, comprising the following additional step:

ceasing to subject said drinking vessel to said freezing temperature(s).

20. The method for holding water and/or an aqueous solution of claim 18, comprising the following additional step:

introducing a fluid, above said water and/or an aqueous solution, and cooling it with said water and/or an aqueous solution.

* * * * *